US012235023B2

(12) United States Patent
Yun et al.

(10) Patent No.: US 12,235,023 B2
(45) Date of Patent: Feb. 25, 2025

(54) METHOD FOR CONTROLLING REFRIGERATOR

(71) Applicant: LG ELECTRONICS INC., Seoul (KR)

(72) Inventors: Seokjun Yun, Seoul (KR); Hyoungkeun Lim, Seoul (KR); Junghun Lee, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 652 days.

(21) Appl. No.: 17/433,403

(22) PCT Filed: Feb. 13, 2020

(86) PCT No.: PCT/KR2020/002075
§ 371 (c)(1),
(2) Date: Mar. 18, 2022

(87) PCT Pub. No.: WO2020/175829
PCT Pub. Date: Sep. 3, 2020

(65) Prior Publication Data

US 2022/0214083 A1 Jul. 7, 2022

(30) Foreign Application Priority Data

Feb. 28, 2019 (KR) ..... 10-2019-0024264

(51) Int. Cl.
*F25B 21/02* (2006.01)
*F25D 11/02* (2006.01)
(Continued)

(52) U.S. Cl.
CPC ..... *F25B 21/02* (2013.01); *F25D 11/02* (2013.01); *F25D 17/065* (2013.01); *F25D 29/00* (2013.01);
(Continued)

(58) Field of Classification Search
CPC .. F25B 21/02; F25B 2321/0212; F25D 11/02; F25D 17/065; F25D 2700/122; F25D 2700/121; F25D 2317/061; F25D 2400/30
See application file for complete search history.

(56) References Cited

U.S. PATENT DOCUMENTS 10,704,812 B2 * 7/2020 Kim ..... F25B 21/02
2012/0023980 A1 2/2012 Lee et al.
(Continued)

FOREIGN PATENT DOCUMENTS

CN 108626932 A 10/2018
JP 2001-289550 A 10/2001
(Continued)

*Primary Examiner* — Lionel Nouketcha
(74) *Attorney, Agent, or Firm* — Bryan Cave Leighton Paisner LLP

(57) ABSTRACT

A method for controlling a refrigerator according to an embodiment of the present invention comprises: if an ultra-low temperature compartment mode is turned on, performing control such that one of low voltage, middle voltage, high voltage, and reverse voltage is applied to the thermoelectric module according to the operation mode of the refrigerator; and if the temperature of the ultra-low temperature compartment is determined to be in a satisfactory temperature range, applying low voltage to the thermoelectric module by the control unit.

13 Claims, 10 Drawing Sheets

(51) Int. Cl.
*F25D 17/06* (2006.01)
*F25D 29/00* (2006.01)

(52) U.S. Cl.
CPC ..... *F25B 2321/0211* (2013.01); *F25B 2321/0212* (2013.01); *F25B 2347/02* (2013.01); *F25D 2700/122* (2013.01)

(56) References Cited

U.S. PATENT DOCUMENTS

| | | | | |
|---|---|---|---|---|
| 2012/0047911 | A1* | 3/2012 | Bhavsar | F25D 11/00 62/3.6 |
| 2018/0187944 | A1 | 7/2018 | Park et al. | |
| 2018/0274826 | A1 | 9/2018 | Kim et al. | |
| 2018/0292119 | A1* | 10/2018 | Sung | F25D 21/006 |

FOREIGN PATENT DOCUMENTS

| | | | | |
|---|---|---|---|---|
| JP | 2016031190 | A | | 3/2016 |
| KR | 10-20040016659 | A | | 2/2004 |
| KR | 20040016659 | A | * | 2/2004 |
| KR | 1020060000943 | A | | 1/2006 |
| KR | 10-2012-0011656 | A | | 2/2012 |
| KR | 20150131715 | A | | 11/2015 |
| KR | 10-20160097648 | A | | 8/2016 |
| KR | 10-1821289 | B1 | | 1/2018 |
| KR | 10-2018-0080652 | A | | 7/2018 |
| KR | 10-20180105572 | A | | 9/2018 |
| KR | 10-20180114591 | A | | 10/2018 |
| KR | 1020180106765 | A | | 10/2018 |
| KR | 20180124451 | A | | 11/2018 |

* cited by examiner (a)

(b)

(c)

METHOD FOR CONTROLLING REFRIGERATOR

This application is a National Stage filing under 35 U.S.C. 371 of International Application No. PCT/KR2020/002075, filed on Feb. 13, 2020, which claims the benefit of Korean Patent Application No. 10-2019-0024264, filed on Feb. 28, 2019, the contents of which are all hereby incorporated by reference herein in their entirety.

TECHNICAL FIELD

The present invention relates to a method for controlling a refrigerator.

BACKGROUND ART

In general, a refrigerator is a home appliance for storing food at a low temperature, and includes a refrigerating compartment for storing food in a refrigerated state in a range of 3° C. and a freezing compartment for storing food in a frozen state in a range of −20° C.

However, when food such as meat or seafood is stored in the frozen state in the existing freezing compartment, moisture in cells of the meat or seafood are escaped out of the cells in the process of freezing the food at the temperature of −20° C., and thus, the cells are destroyed, and taste of the food is changed during an unfreezing process.

However, if a temperature condition for the storage compartment is set to a cryogenic state that is significantly lower than the current temperature of the freezing temperature. Thus, when the food quickly passes through a freezing point temperature range while the food is changed in the frozen state, the destruction of the cells may be minimized, and as a result, even after the unfreezing, the meat quality and the taste of the food may return to close to the state before the freezing. The cryogenic temperature may be understood to mean a temperature in a range of −45° C. to −50° C.

For this reason, in recent years, the demand for a refrigerator equipped with a deep freezing compartment that is maintained at a temperature lower than a temperature of the freezing compartment is increasing.

In order to satisfy the demand for the deep freezing compartment, there is a limit to the cooling using an existing refrigerant. Thus, an attempt is made to lower the temperature of the deep freezing compartment to a cryogenic temperature by using a thermoelectric module (TEM).

Korean Patent Publication No. 2018-0105572 (Sep. 28, 2018) (Prior Art 1) discloses a refrigerator having the form of a bedside table, in which a storage compartment has a temperature lower than the room temperature by using a thermoelectric module.

However, in the case of the refrigerator using the thermoelectric module disclosed in Prior Art 1, since a heat generation surface of the thermoelectric module is configured to be cooled by heat-exchanged with indoor air, there is a limitation in lowering a temperature of the heat absorption surface.

In detail, in the thermoelectric module, when supply current increases, a temperature difference between the heat absorption surface and the heat generation surface tends to increase to a certain level. However, due to characteristics of the thermoelectric element made of a semiconductor element, when the supply current increases, the semiconductor acts as resistance to increase in self-heat amount. Then, there is a problem that heat absorbed from the heat absorption surface is not transferred to the heat generation surface quickly.

In addition, if the heat generation surface of the thermoelectric element is not sufficiently cooled, a phenomenon in which the heat transferred to the heat generation surface flows back toward the heat absorption surface occurs, and a temperature of the heat absorption surface also rises.

In the case of the thermoelectric module disclosed in Prior Art 1, since the heat generation surface is cooled by the indoor air, there is a limit that the temperature of the heat generation surface is not lower than a room temperature.

In a state in which the temperature of the heat generation surface is substantially fixed, the supply current has to increase to lower the temperature of the heat absorption surface, and then efficiency of the thermoelectric module is deteriorated.

In addition, if the supply current increases, a temperature difference between the heat absorption surface and the heat generation surface increases, resulting in a decrease in the cooling capacity of the thermoelectric module.

Therefore, in the case of the refrigerator disclosed in Prior Art 1, it is impossible to lower the temperature of the storage compartment to a cryogenic temperature that is significantly lower than the temperature of the freezing compartment and may be said that it is only possible to maintain the temperature of the refrigerating compartment.

In addition, referring to the contents disclosed in Prior Art 1, since the storage compartment cooled by a thermoelectric module independently exists, when the temperature of the storage compartment reaches a satisfactory temperature, power supply to the thermoelectric module is cut off.

However, when the storage compartment is accommodated in a storage compartment having a different satisfactory temperature region such as a refrigerating compartment or a freezing compartment, factors to be considered in order to control the temperature of the two storage compartments increase.

Therefore, with only the control contents disclosed in Prior Art 1, it is impossible to control an output of the thermoelectric module and an output of a deep freezing compartment cooling fan in order to control the temperature of the deep freezing compartment in a structure in which the deep freezing compartment is accommodated in the freezing compartment or the refrigerating compartment.

In order to overcome limitations of the thermoelectric module and to lower the temperature of the storage compartment to a temperature lower than that of the freezing compartment by using the thermoelectric module, many experiments and studies have been conducted. As a result, in order to cool the heat generation surface of the thermoelectric module to a low temperature, an attempt has been made to attach an evaporator through which a refrigerant flows to the heat generation surface.

Korean Patent Publication No. 10-2016-097648 (Aug. 18, 2016) (Prior Art 2) discloses directly attaching a heat generation surface of a thermoelectric module to an evaporator to cool the heat generation surface of the thermoelectric module.

However, Prior Art 2 still has problems.

In Prior Art 2, an operation control method between an evaporator for cooling the heat generation surface of the thermoelectric module and the freezing compartment evaporator is not described at all. In detail, since a so-called deep freezing compartment cooled by the thermoelectric module is accommodated in the freezing compartment, when a load is applied to either or both of the freezing compartment and the deep freezing compartment, the contents of the control method of the refrigerant circulation system with respect to which storage compartment is prioritized for the load correspondence operation has not been disclosed at all.

In Prior Art 2, when a load is applied to the refrigerating compartment other than the freezing compartment, the contents of how to perform the load correspondence operation are not described at all. This means that only the structure using the evaporator as a cooling means for the heat generation surface of the thermoelectric element has been studied, and when it is actually applied to a refrigerator, it means that research has not been done on problems arising from load input, and the control method to eliminate these problems.

For example, when a load is put into the freezing compartment, moisture is generated inside the freezing compartment, and if the moisture is not removed quickly, the moisture is attached to an outer wall of the deep freezing compartment to cause a problem of forming frost.

Particularly, when the load is simultaneously applied to the refrigerating compartment and the freezing compartment, the refrigerating compartment load correspondence operation is preferentially performed, and the freezing compartment load correspondence operation is not performed. That is, during the refrigerating compartment load correspondence operation, even when the load is applied to the freezing compartment, a freezing compartment fan is not driven, and thus, it is difficult to prevent a problem in that moisture generated inside the freezing compartment is attached to be grown on the outer wall of the deep freezing compartment.

In addition, when the indoor space in which the refrigerating compartment is installed is in a low temperature region such as in winter, an operation rate of the freezing compartment fan is low, and thus, the moisture generated inside the freezing compartment is removed quickly, resulting in a problem that frost is generated on the outer wall of the deep freezing compartment.

A more serious problem is that, when the frost is formed on the outer wall of the deep freezing compartment, there is no suitable method other than a method of physically removing the frost by the user or stopping the operation of the freezing compartment and waiting until the temperature of the freezing compartment increases to a temperature that melts the frost.

If the user removes the frost attached to the outer wall of the deep freezing compartment using a tool, a problem in which the outer wall of the deep freezing compartment is damaged may occur.

If the method of defrosting the frost by stopping the operation of the freezing compartment is selected, there may be a problem in that, if food stored in the freezing compartment does not move to another place, the food is spoiled.

Although the refrigerator having a structure in which the deep freezing compartment is accommodated in the freezing compartment has such a serious problem, in Prior Art 2, there is no mention of such a predictable problem, and there is no mention of a method for responding to the problem.

DISCLOSURE OF THE INVENTION

Technical Problem

The present invention is proposed to solve the expected problems presented above.

In particular, in a structure in which a deep freezing compartment is accommodated in a freezing compartment having a relatively low temperature, an object of the present invention is to provide a method for controlling an output of a thermoelectric element, which is capable of preventing a temperature of a deep freezing compartment from increasing due to penetration of a heat load of the refrigerating compartment into the deep freezing compartment.

In addition, in the structure of a refrigerator in which a deep freezing compartment and a freezing evaporation compartment are disposed adjacent to each other, an object of the present invention is to provide a method for controlling an output of a thermoelectric element, which is capable of preventing a temperature of the deep freezing compartment from increasing due to penetration of a heat load of a freezing evaporation compartment into the deep freezing compartment.

In addition, an object of the present invention is to provide a method for controlling an output of a thermoelectric element, which is capable of preventing a heat load from being penetrated into a deep freezing compartment so as to maintain the deep freezing compartment to a set temperature while a freezing compartment is in a defrosting operation, a refrigerating compartment is in an exclusive operation, or the refrigerating compartment and the freezing compartment are in a simultaneous operation.

In addition, an object of the present invention is to provide a method of controlling an output of a deep freezing compartment fan together with a control of an output of a thermoelectric element so as to control a temperature of the deep freezing compartment.

Technical Solution

In a method for controlling a refrigerator according to an embodiment of the present invention for achieving the above objects, when a deep freezing compartment mode is in an on state, any one of a low voltage, a medium voltage, and a high voltage is controlled to be applied to a thermoelectric module according to an operation mode of the refrigerator, and when it is determined that a temperature of the deep freezing compartment is in a satisfactory temperature region, a controller may apply the low voltage to the thermoelectric module to prevent a heat load from being penetrated from the freezing compartment or an evaporation compartment into the deep freezing compartment.

In addition, a reverse voltage may be applied to the thermoelectric module while a freezing compartment defrost operation is being performed, so that a deep freezing compartment defrost is performed together.

In addition, when the deep freezing compartment is in an unsatisfactory state, and the refrigerating compartment is exclusively operating, the low voltage is applied to the thermoelectric module to prevent a heat sink from overheating and prevent heat from flowing back to cold sink.

In addition, when the deep freezing compartment is in the unsatisfactory state, and a freezing compartment cooling operation is operating, a deep freezing compartment fan is driven at any one of a low speed and a medium speed according to a temperature of the freezing compartment and a room temperature, so that the deep freezing compartment and the freezing compartment reach the satisfactory temperature at a similar time point.

Advantageous Effects

According to the method for controlling the refrigerator according to the embodiment of the present invention, which has the configuration as described above, the following effects and advantages are obtained.

First, in the state in which the deep freezing compartment mode is in the on state, even when the deep freezing compartment temperature is maintained in the satisfactory temperature range, the low voltage may be supplied to the thermoelectric module to prevent the heat load from being transferred from the freezing evaporation compartment to the deep freezing compartment through the thermoelectric module.

Second, the medium voltage may be supplied to the thermoelectric module in the simultaneous operation of the refrigerating compartment and the freezing compartment, and the freezing compartment and the deep freezing compartment may be cooled at the same time to minimize the possibility of the increase in load of the other during the cooling of either the freezing compartment or the deep freezing compartment.

Third, in the refrigerant circulation system in which the heat sink of the thermoelectric module and the freezing compartment evaporator are connected in series, when the temperature of the freezing compartment is in the satisfactory state, there may be the advantage in that the deep freezing compartment is rapidly cooled by supplying the high voltage to the thermoelectric module.

In addition, it may be possible to minimize the amount of liquid refrigerant flowing into the suction pipe connected to the inlet of the compressor by supplying the high voltage to the thermoelectric module and transferring the heat load of the deep freezing compartment to the heat sink as much as possible.

Fourth, the supply of the power to the thermoelectric module may be minimized in the state in which the refrigerant does not flow to the heat sink to minimize the back flow of the heat load from the heat generation surface to the heat absorption surface of the thermoelectric module.

Fifth, when the defrosting operation of the freezing compartment evaporator is performed, the reverse voltage may be applied to the thermoelectric element so that the defrosting operation of the thermoelectric element is performed together, and the vapor generated in the defrosting process of the freezing compartment evaporator may be penetrated into the deep freezing compartment and inner wall of the deep freezing compartment to prevent the surface of the thermoelectric module from being frozen.

MODE FOR CARRYING OUT THE INVENTION

Figure 1:
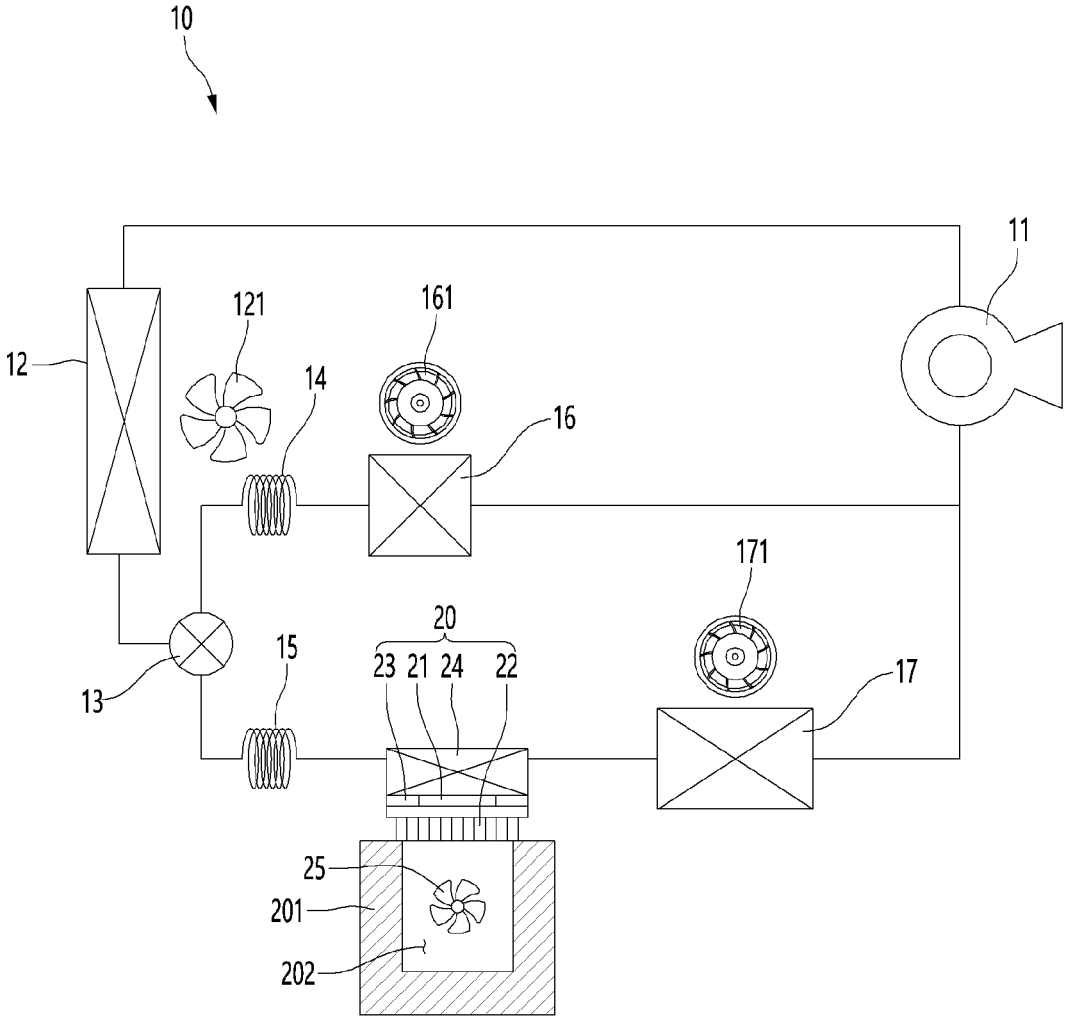
FIG. 1 is a view illustrating a refrigerant circulation system of a refrigerator to which a control method is applied according to an embodiment of the present invention.

Hereinafter, a method for controlling a refrigerator according to an embodiment of the present invention will be described in detail with reference to the accompanying drawings.

In the present invention, a storage compartment that is cooled by a first cooling device and controlled to a predetermined temperature may be defined as a first storage compartment.

In addition, a storage compartment that is cooled by a second cooling device and is controlled to a temperature lower than that of the first storage compartment may be defined as a second storage compartment.

In addition, a storage compartment that is cooled by the third cooling device and is controlled to a temperature lower than that of the second storage compartment may be defined as a third storage compartment.

The first cooling device for cooling the first storage compartment may include at least one of a first evaporator or a first thermoelectric module including a thermoelectric element. The first evaporator may include a refrigerating compartment evaporator to be described later.

The second cooling device for cooling the second storage compartment may include at least one of a second evaporator or a second thermoelectric module including a thermoelectric element. The second evaporator may include a freezing compartment evaporator to be described later.

The third cooling device for cooling the third storage compartment may include at least one of a third evaporator or a third thermoelectric module including a thermoelectric element.

In the embodiments in which the thermoelectric module is used as a cooling means in the present specification, it may be applied by replacing the thermoelectric module with an evaporator, for example, as follows.

(1) "Cold sink of thermoelectric module", "heat absorption surface of thermoelectric module" or "heat absorption side of thermoelectric module" may be interpreted as "evaporator or one side of the evaporator".

(2) "Heat absorption side of thermoelectric module" may be interpreted as the same meaning as "cold sink of thermoelectric module" or "heat absorption side of thermoelectric module".

(3) An electronic controller (processor) "applies or cuts off a constant voltage to the thermoelectric module" may be interpreted as the same meaning as being controlled to "supply or block a refrigerant to the evaporator", "control a switching valve to be opened or closed", or "control a compressor to be turned on or off".

(4) "Controlling the constant voltage applied to the thermoelectric module to increase or decrease" by the controller may be interpreted as the same meaning as "controlling an amount or flow rate of the refrigerant flowing in the evaporator to increase or decrease", "controlling allowing an opening degree of the switching valve to increase or decrease", or "controlling an output of the compressor to increase or decrease".

(5) "Controlling a reverse voltage applied to the thermoelectric module to increase or decrease" by the controller is interpreted as the same meaning as "controlling a voltage applied to the defrost heater adjacent to the evaporator to increase or decrease".

In the present specification, "storage compartment cooled by the thermoelectric module" is defined as a storage compartment A, and "fan located adjacent to the thermoelectric module so that air inside the storage compartment A is heat-exchanged with the heat absorption surface of the thermoelectric module" may be defined as "storage compartment fan A".

Also, a storage compartment cooled by the cooling device while constituting the refrigerator together with the storage compartment A may be defined as "storage compartment B".

In addition, a "cooling device compartment" may be defined as a space in which the cooling device is disposed, in a structure in which the fan for blowing cool air generated by the cooling device is added, the cooling device compartment may be defined as including a space in which the fan is accommodated, and in a structure in which a passage for guiding the cold air blown by the fan to the storage compartment or a passage through which defrost water is discharged is added may be defined as including the passages.

In addition, a defrost heater disposed at one side of the cold sink to remove frost or ice generated on or around the cold sink may be defined as a cold sink defrost heater.

In addition, a defrost heater disposed at one side of the heat sink to remove frost or ice generated on or around the heat sink may be defined as a heat sink defrost heater.

In addition, a defrost heater disposed at one side of the cooling device to remove frost or ice generated on or around the cooling device may be defined as a cooling device defrost heater.

In addition, a defrost heater disposed at one side of a wall surface forming the cooling device chamber to remove frost or ice generated on or around the wall surface forming the cooling device chamber may be defined as a cooling device chamber defrost heater.

In addition, a heater disposed at one side of the cold sink may be defined as a cold sink drain heater in order to minimize refreezing or re-implantation in the process of discharging defrost water or water vapor melted in or around the cold sink.

In addition, a heater disposed at one side of the heat sink may be defined as a heat sink drain heater in order to minimize refreezing or re-implantation in the process of discharging defrost water or water vapor melted in or around the heat sink.

In addition, a heater disposed at one side of the cooling device may be defined as a cooling device drain heater in order to minimize refreezing or re-implantation in the process of discharging defrost water or water vapor melted in or around the cooling device.

In addition, in the process of discharging the defrost water or water vapor melted from or around the wall forming the cooling device chamber, a heater disposed at one side of the wall forming the cooling device chamber may be defined as a cooling device chamber drain heater in order to minimize refreezing or re-implantation.

Also, a "cold sink heater" to be described below may be defined as a heater that performs at least one of a function of the cold sink defrost heater or a function of the cold sink drain heater.

In addition, the "heat sink heater" may be defined as a heater that performs at least one of a function of the heat sink defrost heater or a function of the heat sink drain heater.

In addition, the "cooling device heater" may be defined as a heater that performs at least one of a function of the cooling device defrost heater or a function of the cooling device drain heater.

In addition, a "back heater" to be described below may be defined as a heater that performs at least one of a function of the heat sink heater or a function of the cooling device chamber defrost heater. That is, the back heater may be defined as a heater that performs at least one function among the functions of the heat sink defrost heater, the heater sink drain heater, and the cooling device chamber defrost heater.

In the present invention, as an example, the first storage compartment may include a refrigerating compartment that is capable of being controlled to a zero temperature by the first cooling device.

In addition, the second storage compartment may include a freezing compartment that is capable of being controlled to a temperature below zero by the second cooling device.

In addition, the third storage compartment may include a deep freezing compartment that is capable of being maintained at a cryogenic temperature or an ultrafrezing temperature by the third cooling device.

In the present invention, a case in which all of the third to third storage compartments are controlled to a temperature below zero, a case in which all of the first to third storage compartments are controlled to a zero temperature, and a case in which the first and second storage compartments are controlled to the zero temperature, and the third storage compartment is controlled to the temperature below zero are not excluded.

In the present invention, an "operation" of the refrigerator may be defined as including four processes such as a process (I) of determining whether an operation start condition or an operation input condition is satisfied, a process (II) of performing a predetermined operation when the operation input condition is satisfied, a process (III) of determining whether an operation completion condition is satisfied, and a process (IV) of terminating the operation when the operation completion condition is satisfied.

In the present invention, an "operation" for cooling the storage compartment of the refrigerator may be defined by being divided into a normal operation and a special operation.

The general operation may be referred to as a cooling operation performed when an internal temperature of the refrigerator naturally increases in a state in which the storage compartment door is not opened, or a load input condition due to food storage does not occur.

In detail, when the temperature of the storage compartment enters an unsatisfactory temperature region (described below in detail with reference to the drawings), and the operation input condition is satisfied, the controller controls the cold air to be supplied from the cooling device of the storage compartment so as to cool the storage compartment.

Specifically, the normal operation may include a refrigerating compartment cooling operation, a freezing compartment cooling operation, a deep freezing compartment cooling operation, and the like.

On the other hand, the special operation may mean an operation other than the operations defined as the normal operation.

In detail, the special operation may include a defrost operation controlled to supply heat to the cooling device so as to melt the frost or ice deposited on the cooling device after a defrost period of the storage compartment elapses.

In addition, the special operation may further include a load correspondence operation for controlling the cold air to be supplied from the cooling device to the storage compartment so as to remove a heat load penetrated into the storage compartment when a set time elapses from a time when a door of the storage compartment is opened and closed, or when a temperature of the storage compartment rises to a set temperature before the set time elapses.

In detail, the load correspondence operation includes a door load correspondence operation performed to remove a load penetrated into the storage compartment after opening and closing of the storage compartment door, and an initial cold start operation performed to remove a load correspondence operation performed to remove a load inside the storage compartment when power is first applied after installing the refrigerator.

For example, the defrost operation may include at least one of a refrigerating compartment defrost operation, a freezing compartment defrost operation, and a deep freezing compartment defrost operation.

Also, the door load correspondence operation may include at least one of a refrigerating compartment door load correspondence operation, a freezing compartment door load correspondence operation, and a deep freezing compartment load correspondence operation.

Here, the deep freezing compartment load correspondence operation may be interpreted as an operation for removing the deep freezing compartment load, which is performed when at least one condition for the deep freezing compartment door load correspondence input condition performed when the load increases due to the opening of the door of the deep freezing compartment, the initial cold start operation input condition preformed to remove the load within the deep freezing compartment when the deep freezing compartment is switched from an on state to an off state, or the operation input condition after the defrosting that initially stats after the deep freezing compartment defrost operation is completed.

In detail, determining whether the operation input condition corresponding to the load of the deep freezing compartment door is satisfied may include determining whether at least one of a condition in which a predetermined amount of time elapses from at time point at which at least one of the freezing compartment door and the deep freezing compartment door is closed after being opened, or a condition in which a temperature of the deep freezing compartment rises to a set temperature within a predetermined time is satisfied.

In addition, determining whether the initial cold start operation input condition for the deep freezing compartment is satisfied may include determining whether the refrigerator is powered on, and the deep freezing compartment mode is switched from the off state to the on state.

In addition, determining whether the operation input condition is satisfied after the deep freezing compartment defrost may include determining at least one of stopping of the reverse voltage applied to the thermoelectric module for cold sink heater off, back heater off, cold sink defrost, stopping of the constant voltage applied to the thermoelectric module for the heat sink defrost after the reverse voltage is applied for the cold sink defrost, an increase of a temperature of a housing accommodating the heat sink to a set temperature, or terminating of the freezing compartment defrost operation.

Thus, the operation of the storage compartment including at least one of the refrigerating compartment, the freezing compartment, or the deep freezing compartment may be summarized as including the normal storage compartment operation and the storage compartment special operation.

When two operations conflict with each other during the operation of the storage compartment described above, the controller may control one operation (operation A) to be performed preferentially and the other operation (operation B) to be paused.

In the present invention, the conflict of the operations may include i) a case in which an input condition for the operation A and an input condition for the operation B are satisfied at the same time to conflict with each other, a case in which the input condition for the operation B is satisfied while the input condition for the operation A is satisfied to perform the operation A to conflict with each other, and a case in which the input condition for operation A is satisfied while the input condition for the operation B is satisfied to perform the operation B to conflict with each other.

When the two operations conflict with each other, the controller determines the performance priority of the conflicting operations to perform a so-called "conflict control algorithm" to be executed in order to control the performance of the correspondence operation.

A case in which the operation A is performed first, and the operation B is stopped will be described as an example.

In detail, in the present invention, the paused operation B may be controlled to follow at least one of the three cases of the following example after the completion of the operation A.

a. Termination of Operation B

When the operation A is completed, the performance of the operation B may be released to terminate the conflict control algorithm and return to the previous operation process.

Here, the "release" does not determine whether the paused operation B is not performed any more, and whether the input condition for the operation B is satisfied. That is, it is seen that the determination information on the input condition for the operation B is initialized.

b. Redetermination of Input Condition of Operation B

When the firstly performed operation A is completed, the controller may return to the process of determining again whether the input condition for the paused operation B is satisfied, and determine whether the operation B restarts.

For example, if the operation B is an operation in which the fan is driven for 10 minutes, and the operation is stopped when 3 minutes elapses after the start of the operation due to the conflict with the operation A, it is determined again whether the input condition for the operation B is satisfied at a time point at which the operation A is completed, and if it is determined to be satisfied, the fan is driven again for 10 minutes.

c. Continuation of Operation B

When the firstly performed operation A is completed, the controller may allow the paused operation B to be continued. Here, "continuation" means not to start over from the beginning, but to continue the paused operation.

For example, if the operation B is an operation in which the fan is driven for 10 minutes, and the operation is paused after 3 minutes elapses after the start of the operation due to the conflict with operation A, the compressor is further driven for the remaining time of 7 minutes immediately after the operation A is completed.

In the present invention, the priority of the operations may be determined as follows.

First, when the normal operation and the special operation conflict with each other, it is possible to control the special operation to be performed preferentially.

Second, when the conflict between the normal operations occurs, the priority of the operations may be determined as follows.

I. When the refrigerating compartment cooling operation and the freezing compartment cooling operation conflict with each other, the refrigerating compartment cooling operation may be performed preferentially.

II. When the refrigerating compartment (or freezing compartment) cooling operation and the deep freezing compartment cooling operation conflict with each other, the refrigerating compartment (or freezing compartment) cooling operation may be performed preferentially. Here, in order to prevent the deep freezing compartment temperature from rising excessively, cooling capacity having a level lower than that of maximum cooling capacity of the deep freezing compartment cooling device may be supplied from the deep freezing compartment cooling device to the deep freezing compartment.

The cooling capacity may mean at least one of cooling capacity of the cooling device itself and an airflow amount of the cooling fan disposed adjacent to the cooling device. For example, when the cooling device of the deep freezing compartment is the thermoelectric module, the controller may perform the refrigerating compartment (or freezing compartment) cooling operation with priority when the refrigerating compartment (or freezing compartment) cooling operation and the deep freezing compartment cooling operation conflict with each other. Here, a voltage lower than a maximum voltage that is capable of being applied to the thermoelectric module may be input into the thermoelectric module.

Third, when the conflict between special operations occurs, the priority of the operations may be determined as follows.

I. When a refrigerating compartment door load correspondence operation conflicts with a freezing compartment door load correspondence operation, the controller may control the refrigerating compartment door load correspondence operation to be performed with priority.

II. When the freezing compartment door load correspondence operation conflicts with the deep freezing compartment door load correspondence operation, the controller may control the deep freezing compartment door load correspondence operation to be performed with priority.

III. If the refrigerating compartment operation and the deep freezing compartment door load correspondence operation conflict with each other, the controller may control the refrigerating compartment operation and the deep freezing compartment door load correspondence operation so as to be performed at the same time. Then, when the temperature of the refrigerating compartment reaches a specific temperature a, the controller may control the deep freezing compartment door load correspondence operation so as to be performed exclusively. When the refrigerating compartment temperature rises again to reach a specific temperature b (a<b) while the deep freezing compartment door load correspondence operation is performed independently, the controller may control the refrigerating compartment operation and the deep freezing compartment door load correspondence operation so as to be performed at the same time. Thereafter, an operation switching process between the simultaneous operation of the deep freezing compartment and the refrigerating compartment and the exclusive operation of the deep freezing compartment may be controlled to be repeatedly performed according to the temperature of the refrigerating compartment.

As an extended modified example, when the operation input condition for the deep freezing compartment load correspondence operation is satisfied, the controller may control the operation to be performed in the same manner as when the refrigerating compartment operation and the deep freezing compartment door load correspondence operation conflict with each other.

Hereinafter, as an example, the description is limited to the case in which the first storage compartment is the refrigerating compartment, the second storage compartment is the freezing compartment, and the third storage compartment is the deep freezing compartment.

FIG. 1 is a view illustrating a refrigerant circulation system of a refrigerator according to an embodiment of the present invention.

Referring to FIG. 1, a refrigerant circulation system according to an embodiment of the present invention includes a compressor 11 that compresses a refrigerant into a high-temperature and high-pressure gaseous refrigerant, a condenser 12 that condenses the refrigerant discharged from the compressor 11 into a high-temperature and high-pressure liquid refrigerant, an expansion valve that expands the refrigerant discharged from the condenser 12 into a low-temperature and low-pressure two-phase refrigerant, and an evaporator that evaporates the refrigerant passing through the expansion valve into a low-temperature and low-pressure gaseous refrigerant. The refrigerant discharged from the evaporator flows into the compressor 11. The above components are connected to each other by a refrigerant pipe to constitute a closed circuit.

In detail, the expansion valve may include a refrigerating compartment expansion valve 14 and a freezing compartment expansion valve 15. The refrigerant pipe is divided into two branches at an outlet side of the condenser 12, and the refrigerating compartment expansion valve 14 and the freezing compartment expansion valve 15 are respectively connected to the refrigerant pipe that is divided into the two branches. That is, the refrigerating compartment expansion valve 14 and the freezing compartment expansion valve 15 are connected in parallel at the outlet of the condenser 12.

A switching valve 13 is mounted at a point at which the refrigerant pipe is divided into the two branches at the outlet side of the condenser 12. The refrigerant passing through the condenser 12 may flow through only one of the refrigerating compartment expansion valve 14 and the freezing compartment expansion valve 15 by an operation of adjusting an opening degree of the switching valve 13 or may flow to be divided into both sides.

The switching valve 13 may be a three-way valve, and a flow direction of the refrigerant is determined according to an operation mode. Here, one switching valve such as the three-way valve may be mounted at an outlet of the condenser to control the flow direction of the refrigerant, or alternatively, the switching valves are mounted at inlet sides of a refrigerating compartment expansion valve 14 and a freezing compartment expansion valve 15, respectively.

As a first example of an evaporator arrangement manner, the evaporator may include a refrigerating compartment evaporator 16 connected to an outlet side of the refrigerating compartment expansion valve 14 and a heat sink and a freezing compartment evaporator 17, which are connected in series to an outlet side of the freezing compartment expansion valve 15. The heat sink 24 and the freezing compartment evaporator 17 are connected in series, and the refrigerant passing through the freezing compartment expansion valve passes through the heat sink 24 and then flows into the freezing compartment evaporator 17.

As a second example, the heat sink 24 may be disposed at an outlet side of the freezing compartment evaporator 17 so that the refrigerant passing through the freezing compartment evaporator 17 flows into the heat sink 24.

As a third example, a structure in which the heat sink 24 and the freezing compartment evaporator 17 are connected in parallel at an outlet end of the freezing compartment expansion valve 15 is not excluded.

Although the heat sink 24 is the evaporator, it is provided for the purpose of cooling a heat generation surface of the thermoelectric module to be described later, not for the purpose of heat-exchange with the cold air of the deep freezing compartment.

In each of the three examples described above with respect to the arrangement manner of the evaporator, a complex system of a first refrigerant circulation system, in which the switching valve 13, the refrigerating compartment expansion valve 14, and the refrigerating compartment evaporator 16 are removed, and a second refrigerant circulation system constituted by the refrigerating compartment cooling evaporator, the refrigerating compartment cooling expansion valve, the refrigerating compartment cooling condenser, and a refrigerating compartment cooling compressor is also possible. Here, the condenser constituting the first refrigerant circulation system and the condenser constituting the second refrigerant circulation system may be independently provided, and a complex condenser which is provided as a single body and in which the refrigerant is not mixed may be provided.

The refrigerant circulation system of the refrigerator having the two storage compartments including the deep freezing compartment may be configured only with the first refrigerant circulation system.

Hereinafter, as an example, the description will be limited to a structure in which the heat sink and the freezing compartment evaporator 17 are connected in series.

A condensing fan 121 is mounted adjacent to the condenser 12, a refrigerating compartment fan 161 is mounted adjacent to the refrigerating compartment evaporator 16, and a freezing compartment fan 171 is mounted adjacent to the freezing compartment evaporator 17.

A refrigerating compartment maintained at a refrigerating temperature by cold air generated by the refrigerating compartment evaporator 16, a freezing compartment maintained at a freezing temperature by cold air generated by the freezing compartment evaporator 16, and a deep freezing compartment 202 maintained at a cryogenic or ultrafrezing temperature by a thermoelectric module to be described later are formed inside the refrigerator provided with the refrigerant circulation system according to the embodiment of the present invention. The refrigerating compartment and the freezing compartment may be disposed adjacent to each other in a vertical direction or horizontal direction and are partitioned from each other by a partition wall. The deep freezing compartment may be provided at one side of the inside of the freezing compartment, but the present invention includes the deep freezing compartment provided at one side of the outside of the freezing compartment. In order to block the heat exchange between the cold air of the deep freezing compartment and the cold air of the freezing compartment, the deep freezing compartment 202 may be partitioned from the freezing compartment by a deep freezing case 201 having the high thermal insulation performance.

In addition, the thermoelectric module includes a thermoelectric element 21 having one side through which heat is absorbed and the other side through which heat is released when power is supplied, a cold sink 22 mounted on the heat absorption surface of the thermoelectric element 21, a heat sink mounted on the heat generation surface of the thermoelectric element 21, and an insulator 23 that blocks heat exchange between the cold sink 22 and the heat sink.

Here, the heat sink 24 is an evaporator that is in contact with the heat generation surface of the thermoelectric element 21. That is, the heat transferred to the heat generation surface of the thermoelectric element 21 is heat-exchanged with the refrigerant flowing inside the heat sink 24. The refrigerant flowing along the inside of the heat sink 24 and absorbing heat from the heat generation surface of the thermoelectric element 21 is introduced into the freezing compartment evaporator 17.

In addition, a cooling fan may be provided in front of the cold sink 22, and the cooling fan may be defined as the deep freezing compartment fan 25 because the fan is disposed behind the inside of the deep freezing compartment.

The cold sink 22 is disposed behind the inside of the deep freezing compartment 202 and configured to be exposed to the cold air of the deep freezing compartment 202. Thus, when the deep freezing compartment fan 25 is driven to forcibly circulate cold air in the deep freezing compartment 202, the cold sink 22 absorbs heat through heat-exchange with the cold air in the deep freezing compartment and then is transferred to the heat absorption surface of the thermoelectric element 21. The heat transferred to the heat absorption surface is transferred to the heat generation surface of the thermoelectric element 21.

The heat sink 24 functions to absorb the heat absorbed from the heat absorption surface of the thermoelectric element 21 and transferred to the heat generation surface of the thermoelectric element 21 again to release the heat to the outside of the thermoelectric module 20.

Figure 2:
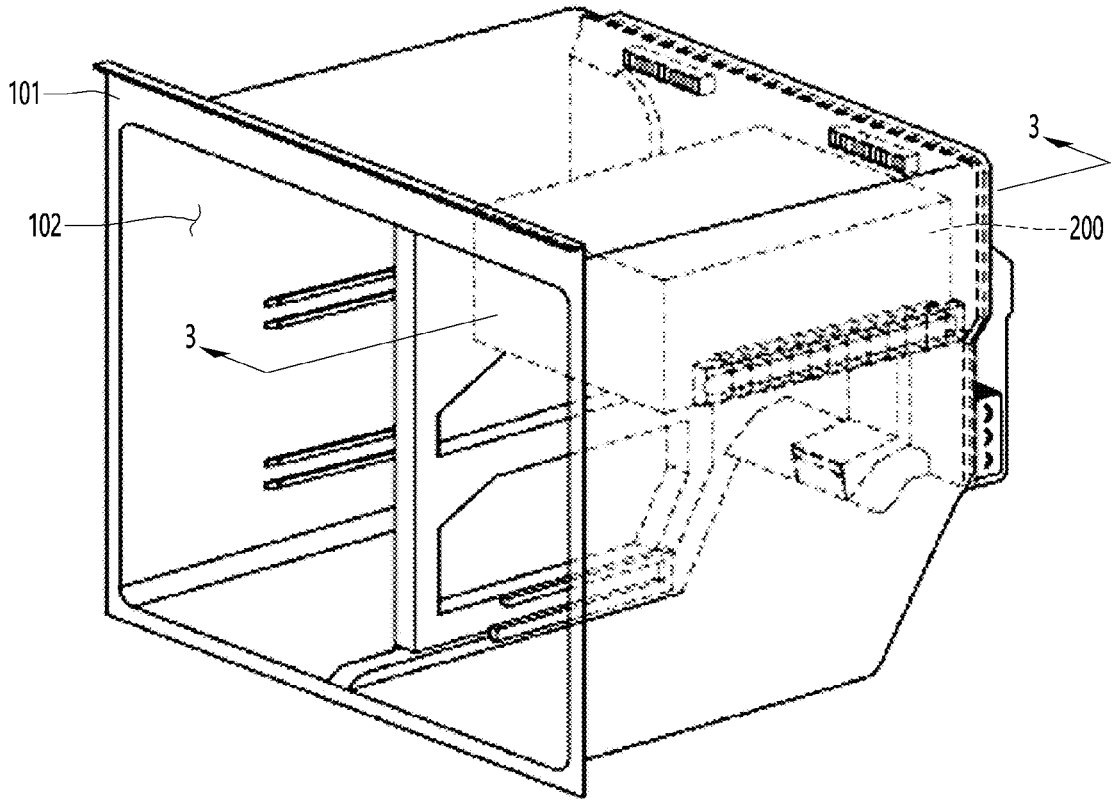
FIG. 2 is a perspective view illustrating structures of a freezing compartment and a deep freezing compartment of the refrigerator according to an embodiment of the present invention.
Figure 3:
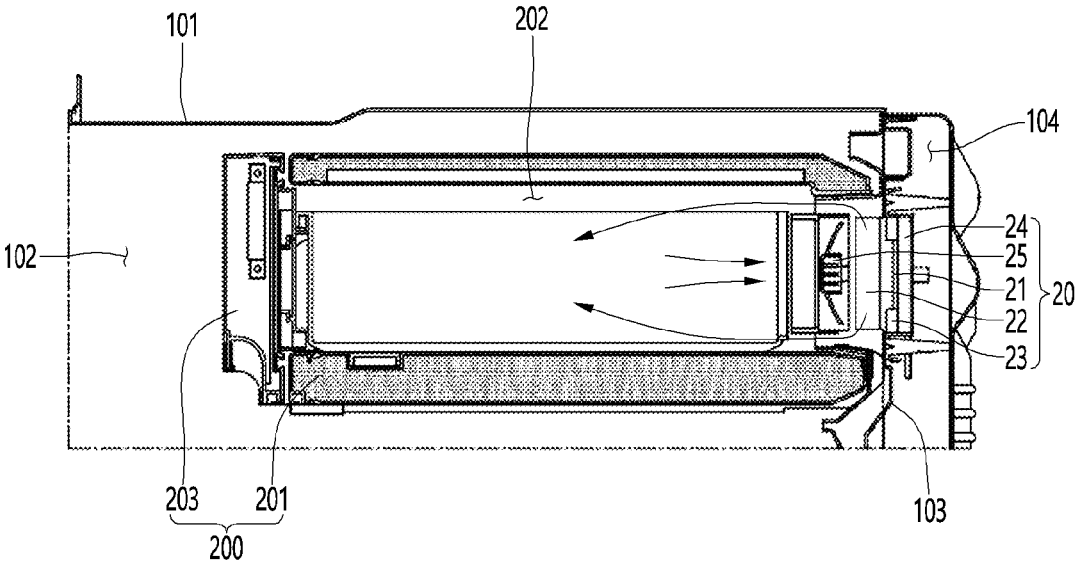
FIG. 3 is a longitudinal cross-sectional view taken along line 3-3 of FIG. 2.

FIG. 2 is a perspective view illustrating structures of the freezing compartment and the deep freezing compartment of the refrigerator according to an embodiment of the present invention, and FIG. 3 is a longitudinal cross-sectional view taken along line 3-3 of FIG. 2.

Referring to FIGS. 2 and 3, the refrigerator according to an embodiment of the present invention includes an inner case 101 defining the freezing compartment 102 and a deep freezing unit 200 mounted at one side of the inside of the freezing compartment 102.

In detail, the inside of the refrigerating compartment is maintained to a temperature of about 3° C., and the inside of the freezing compartment 102 is maintained to a temperature of about −18° C., whereas a temperature inside the deep freezing unit 200, i.e., an internal temperature of the deep freezing compartment 202 has to be maintained to about −50° C. Therefore, in order to maintain the internal temperature of the deep freezing compartment 202 at a cryogenic temperature of −50° C., an additional freezing means such as the thermoelectric module 20 is required in addition to the freezing compartment evaporator.

In more detail, the deep freezing unit 200 includes a deep freezing case 201 that forms a deep freezing compartment 202 therein, a deep freezing compartment drawer 203 slidably inserted into the deep freezing case 201, and a thermoelectric module 20 mounted on a rear surface of the deep freezing case 201.

Instead of applying the deep freezing compartment drawer 203, a structure in which a deep freezing compartment door is connected to one side of the front side of the deep freezing case 201, and the entire inside of the deep freezing compartment 201 is configured as a food storage space is also possible.

In addition, the rear surface of the inner case 101 is stepped backward to form a freezing evaporation compartment 104 in which the freezing compartment evaporator 17 is accommodated. In addition, an inner space of the inner case 101 is divided into the freezing evaporation compartment 104 and the freezing compartment 102 by the partition wall 103. The thermoelectric module 20 is fixedly mounted on a front surface of the partition wall 103, and a portion of the thermoelectric module 20 passes through the deep freezing case 201 and is accommodated in the deep freezing compartment 202.

In detail, the heat sink 24 constituting the thermoelectric module 20 may be an evaporator connected to the freezing compartment expansion valve 15 as described above. A space in which the heat sink 24 is accommodated may be formed in the partition wall 103.

Since the two-phase refrigerant cooled to a temperature of about −18° C. to −20° C. while passing through the freezing compartment expansion valve 15 flows inside the heat sink 24, a surface temperature of the heat sink 24 may be maintained to a temperature of −18° C. to −20° C. Here, it is noted that a temperature and pressure of the refrigerant passing through the freezing compartment expansion valve 15 may vary depending on the freezing compartment temperature condition.

When a rear surface of the thermoelectric element 21 is in contact with a front surface of the heat sink 24, and power is applied to the thermoelectric element 21, the rear surface of the thermoelectric element 21 becomes a heat generation surface.

When the cold sink 22 is in contact with a front surface of the thermoelectric element, and power is applied to the thermoelectric element 21, the front surface of the thermoelectric element 21 becomes a heat absorption surface.

The cold sink 22 may include a heat conduction plate made of an aluminum material and a plurality of heat exchange fins extending from a front surface of the heat conduction plate. Here, the plurality of heat exchange fins extend vertically and are disposed to be spaced apart from each other in a horizontal direction.

Here, when a housing surrounding or accommodating at least a portion of a heat conductor constituted by the heat conduction plate and the heat exchange fin is provided, the cold sink 22 has to be interpreted as a heat transfer member including the housing as well as the heat conductor. This is equally applied to the heat sink 22, and the heat sink 22 has be interpreted not only as the heat conductor constituted by the heat conduction plate and the heat exchange fin, but also as the heat transfer member including the housing when a housing is provided.

The deep freezing compartment fan 25 is disposed in front of the cold sink 22 to forcibly circulate air inside the deep freezing compartment 202.

Hereinafter, efficiency and cooling capacity of the thermoelectric element will be described.

The efficiency of the thermoelectric module 20 may be defined as a coefficient of performance (COP), and an efficiency equation is as follows.

$$COP = \frac{Q_c}{P_e}$$

$Q_c$: Cooling Capacity (ability to absorb heat)

$P_e$: Input Power (power supplied to thermoelectric element)

$$P_e = V \times i$$

In addition, the cooling capacity of the thermoelectric module 20 may be defined as follows.

$$Q_c = \alpha T_c i - \frac{1}{2}\frac{\rho L}{A} i^2 - \frac{kA}{L}(T_h - T_c)$$

<Semiconductor Material Property Coefficient>

α: Seebeck Coefficient [V/K]

ρ: Specific Resistance [Ωm−1]

k: Thermal conductivity [Ωm−1]

<Semiconductor Structure Characteristics>

L: Thickness of thermoelectric element: Distance between heat absorption surface and heat generation surface A: Area of thermoelectric element <System Use Condition> i: Current

V: Voltage

Th: Temperature of heat generation surface of thermoelectric element

Tc: Temperature of heat absorption surface of thermoelectric module

In the above cooling capacity equation, a first item at the right may be defined as a Peltier Effect and may be defined as an amount of heat transferred between both ends of the heat absorption surface and the heat generation surface by a voltage difference. The Peltier effect increases in proportional to supply current as a function of current.

In the formula V=iR, since a semiconductor constituting the thermoelectric module acts as resistance, and the resistance may be regarded as a constant, it may be said that a voltage and current have a proportional relationship. That is, when the voltage applied to the thermoelectric module 21 increases, the current also increases. Accordingly, the Peltier effect may be seen as a current function or as a voltage function.

The cooling capacity may also be seen as a current function or a voltage function. The Peltier effect acts as a positive effect of increasing in cooling capacity. That is, as the supply voltage increases, the Peltier effect increases to increase in cooling capacity.

The second item in the cooling capacity equation is defined as a Joule Effect.

The Joule effect means an effect in which heat is generated when current is applied to a resistor. In other words, since heat is generated when power is supplied to the thermoelectric module, this acts as a negative effect of reducing the cooling capacity. Therefore, when the voltage supplied to the thermoelectric module increases, the Joule effect increases, resulting in lowering of the cooling capacity of the thermoelectric module.

The third item in the cooling capacity equation is defined as a Fourier effect.

The Fourier effect means an effect in which heat is transferred by heat conduction when a temperature difference occurs on both surfaces of the thermoelectric module.

In detail, the thermoelectric module includes a heat absorption surface and a heat generation surface, each of which is provided as a ceramic substrate, and a semiconductor disposed between the heat absorption surface and the heat generation surface. When a voltage is applied to the thermoelectric module, a temperature difference is generated between the heat absorption surface and the heat generation surface. The heat absorbed through the heat absorption surface passes through the semiconductor and is transferred to the heat generation surface. However, when the temperature difference between the heat absorption surface and the heat absorption surface occurs, a phenomenon in which heat flows backward from the heat generation surface to the heat absorption surface by heat conduction occurs, which is referred to as the Fourier effect.

Like the Joule effect, the Fourier effect acts as a negative effect of lowering the cooling capacity. In other words, when the supply current increases, the temperature difference (Th−Tc) between the heat generation surface and the heat absorption surface of the thermoelectric module, i.e., a value ΔT, increases, resulting in lowering of the cooling capacity.

Figure 4:
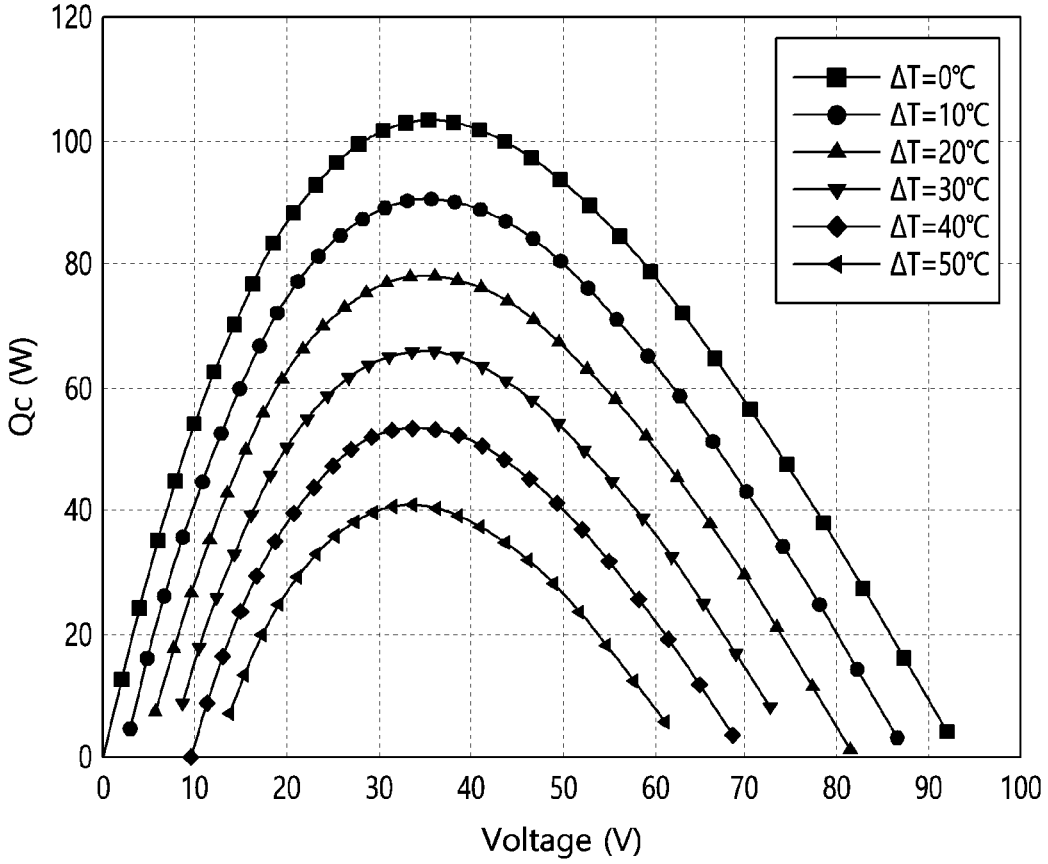
FIG. 4 is a graph illustrating a relationship of cooling capacity with respect to an input voltage and a Fourier effect.

FIG. 4 is a graph illustrating a relationship of cooling capacity with respect to the input voltage and the Fourier effect.

Referring to FIG. 4, the Fourier effect may be defined as a function of the temperature difference between the heat absorption surface and the heat generation surface, that is, a value ΔT.

In detail, when specifications of the thermoelectric module are determined, values k, A, and L in the item of the Fourier effect in the above cooling capacity equation become constant values, and thus, the Fourier effect may be seen as a function with the value ΔT as a variable.

Therefore, as the value ΔT increases, the value of the Fourier effect increases, but the Fourier effect acts as a negative effect on the cooling capacity, and thus the cooling capacity decreases.

As shown in the graph of FIG. 4, it is seen that the greater the value ΔT under the constant voltage condition, the less the cooling capacity.

In addition, when the value ΔT is fixed, for example, when ΔT is 30° C., a change in cooling capacity according to a change of the voltage is observed. As the voltage value increases, the cooling capacity increases and has a maximum value at a certain point and then decreases again.

Here, since the voltage and current have a proportional relationship, it should be noted that it is no matter to view the current described in the cooling capacity equation as the voltage and be interpreted in the same manner.

In detail, the cooling capacity increases as the supply voltage (or current) increases, which may be explained by the above cooling capacity equation. First, since the value ΔT is fixed, the value ΔT becomes a constant. Since the ΔT value for each standard of the thermoelectric module is determined, an appropriate standard of the thermoelectric module may be set according to the required value ΔT.

Since the value ΔT is fixed, the Fourier effect may be seen as a constant, and the cooling capacity may be simplified into a function of the Peltier effect, which is seen as a first-order function of the voltage (or current), and the Joule effect, which is seen as a second-order function of the voltage (or current).

As the voltage value gradually increases, an amount of increase in Peltier effect, which is the first-order function of the voltage, is larger than that of increase in Joule effect, which is the second-order function, of voltage, and consequently, the cooling capacity increases. In other words, until the cooling capacity is maximized, the function of the Joule effect is close to a constant, so that the cooling capacity approaches the first-order function of the voltage.

As the voltage further increases, it is seen that a reversal phenomenon, in which a self-heat generation amount due to the Joule effect is greater than a transfer heat amount due to the Peltier effect, occurs, and as a result, the cooling capacity decreases again. This may be more clearly understood from the functional relationship between the Peltier effect, which is the first-order function of the voltage (or current), and the Joule effect, which is the second-order function of the voltage (or current). That is, when the cooling capacity decreases, the cooling capacity is close to the second-order function of the voltage.

In the graph of FIG. 4, it is confirmed that the cooling capacity is maximum when the supply voltage is in a range of about 30 V to about 40 V, more specifically, about 35 V. Therefore, if only the cooling capacity is considered, it is said that it is preferable to generate a voltage difference within a range of 30 V to 40V in the thermoelectric module.

Figure 5:
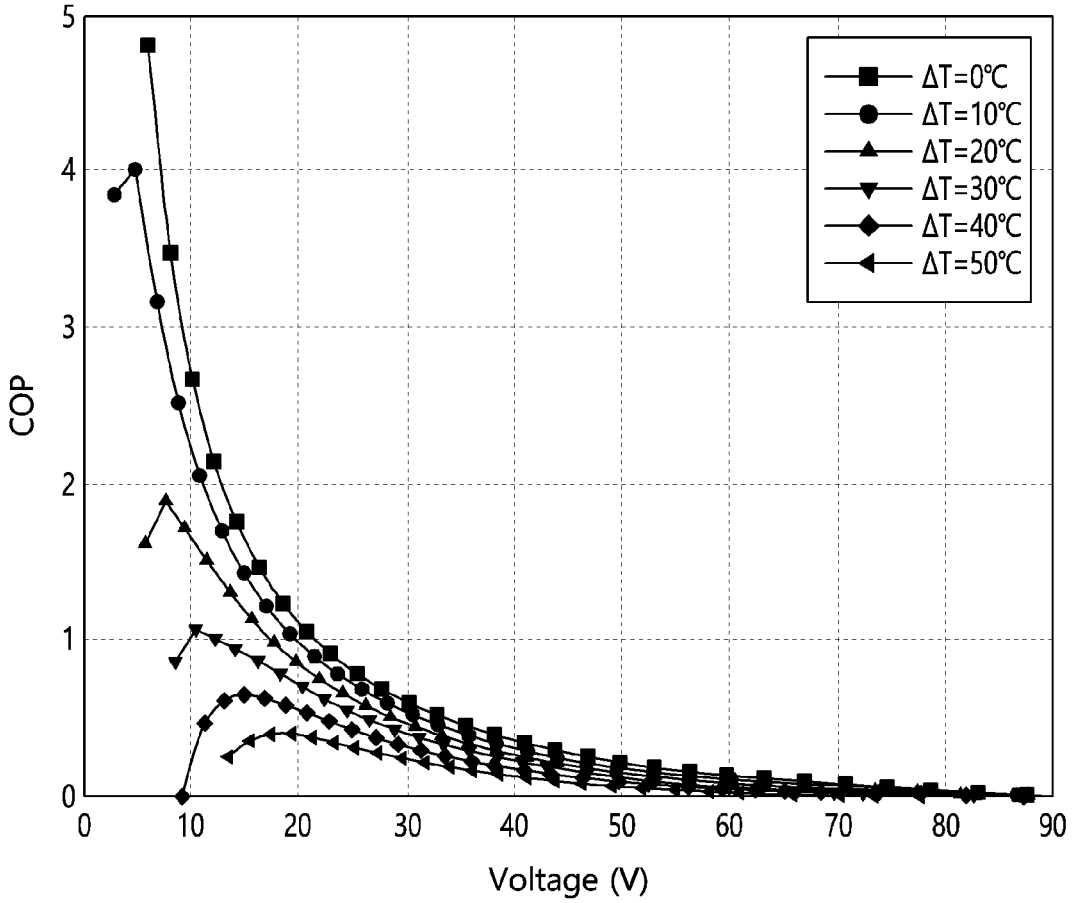
FIG. 5 is a graph illustrating a relationship of efficiency with respect to an input voltage and a Fourier effect.

FIG. 5 is a graph illustrating a relationship of efficiency with respect to the input voltage and the Fourier effect.

Referring to FIG. 5, it is seen that the higher the value ΔT, the lower the efficiency at the same voltage. This will be noted as a natural result because the efficiency is proportional to the cooling capacity.

In addition, when the value ΔT is fixed, for example, when the value ΔT is limited to 30° C. and the change in efficiency according to the change in voltage is observed, the efficiency increases as the supply voltage increases, and the efficiency decreases after a certain time point elapses. This is said to be similar to the graph of the cooling capacity according to the change of the voltage.

Here, the efficiency (COP) is a function of input power as well as cooling capacity, and the input Pe becomes a function of $V^2$ when the resistance of the thermoelectric module 21 is considered as the constant. If the cooling capacity is divided by $V^2$, the efficiency may be expressed as Peltier effect−Peltier effect/$V^2$. Therefore, it is seen that the graph of the efficiency has a shape as illustrated in FIG. 5.

It is seen from the graph of FIG. 5, in which a point at which the efficiency is maximum appears in a region in which the voltage difference (or supply voltage) applied to the thermoelectric module is less than about 20 V. Therefore, when the required value ΔT is determined, it is good to apply an appropriate voltage according to the value to maximize the efficiency. That is, when a temperature of the heat sink and a set temperature of the deep freezing compartment 202 are determined, the value ΔT is determined, and accordingly, an optimal difference of the voltage applied to the thermoelectric module may be determined.

Figure 6:
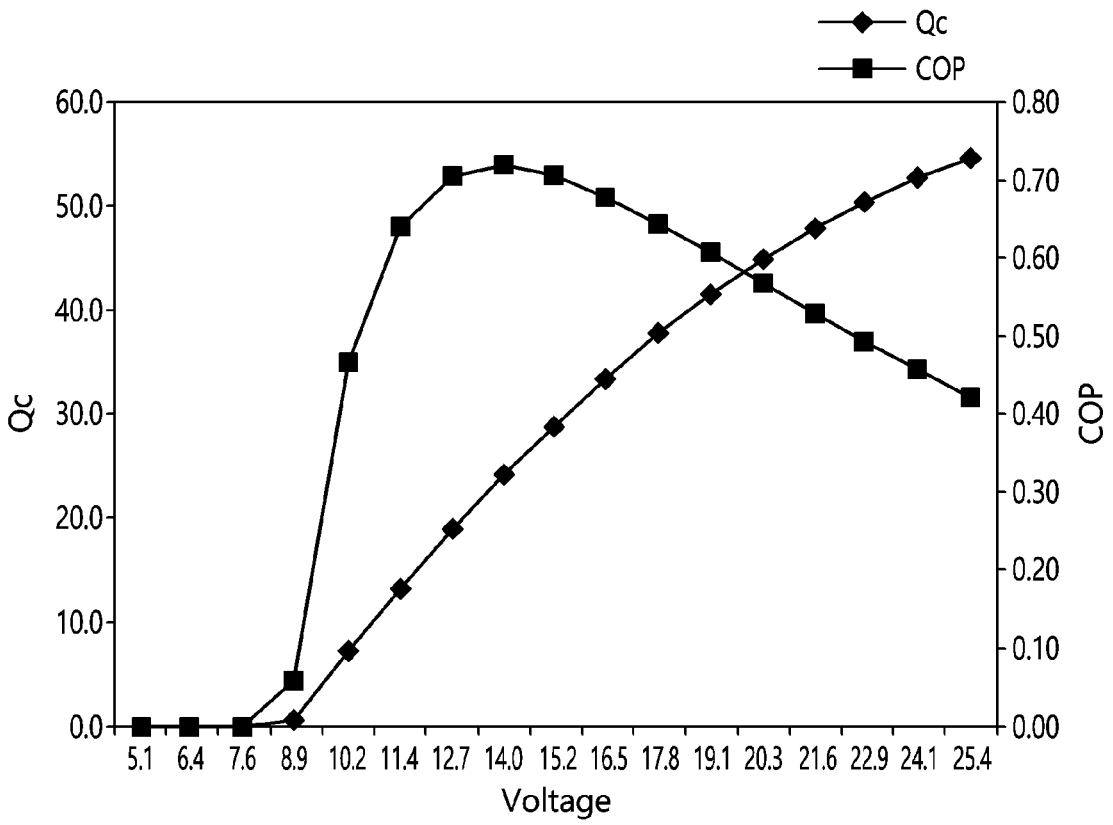
FIG. 6 is a graph illustrating a relationship of cooling capacity and efficiency according to a voltage.

FIG. 6 is a graph illustrating a relationship of the cooling capacity and the efficiency according to a voltage.

Referring to FIG. 6, as described above, as the voltage difference increases, both the cooling capacity and efficiency increase and then decrease.

In detail, it is seen that the voltage value at which the cooling capacity is maximized and the voltage value at which the efficiency is maximized are different from each other. This is seen that the voltage is the first-order function, and the efficiency is the second-order function until the cooling capacity is maximized.

As illustrated in FIG. 6, as an example, in the case of the thermoelectric module having ΔT of 30° C., it is confirmed that the thermoelectric module has the highest efficiency within a range of approximately 12 V to 17 V of the voltage applied to the thermoelectric module. Within the above voltage range, the cooling capacity continues to increase. Therefore, it is seen that a voltage difference of at least 12 V is required in consideration of the cooling capacity, and the efficiency is maximum when the voltage difference is 14 V.

Figure 7:
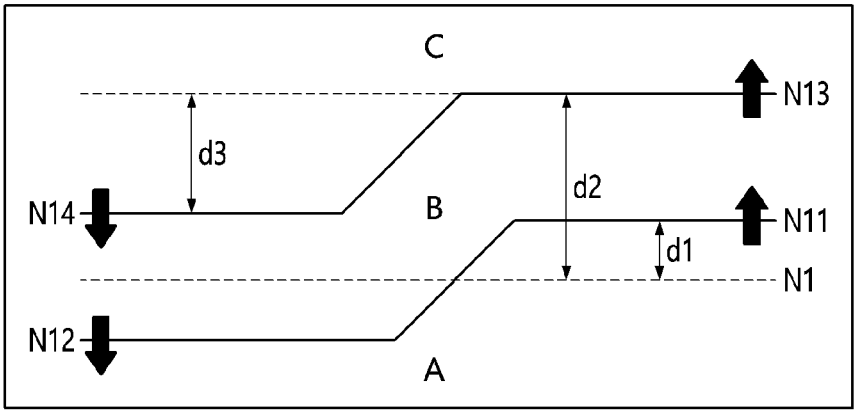
FIG. 7 is a view illustrating a reference temperature line for controlling a refrigerator according to a change in load inside the refrigerator.
Figure 7:
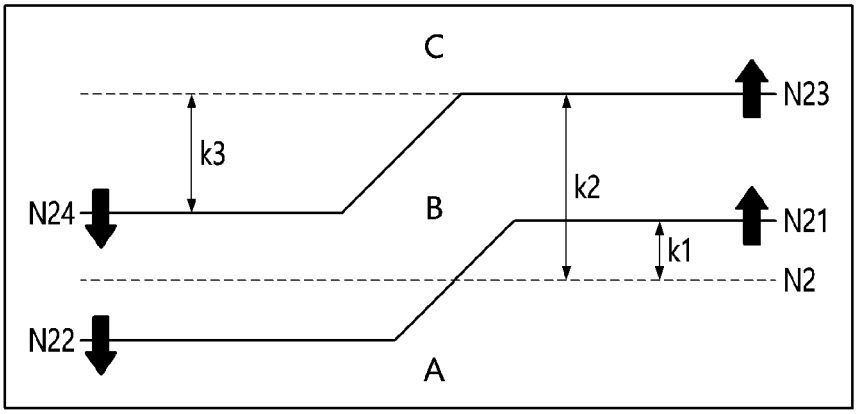
Figure 7:
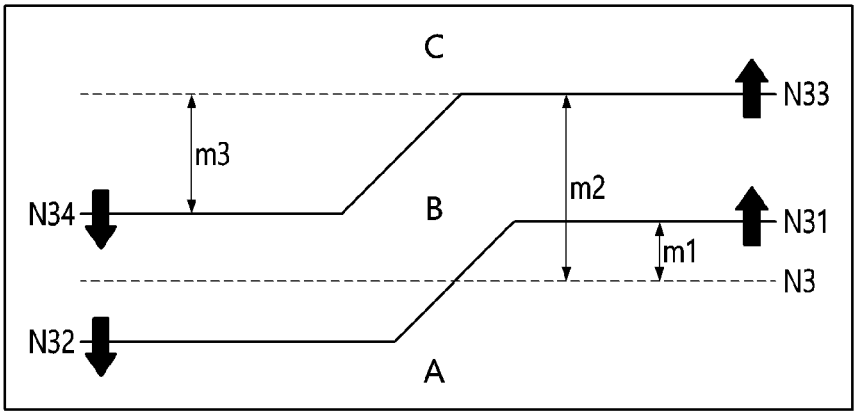

FIG. 7 is a view illustrating a reference temperature line for controlling the refrigerator according to a change in load inside the refrigerator.

Hereinafter, a set temperature of each storage compartment will be described by being defined as a notch temperature. The reference temperature line may be expressed as a critical temperature line.

A lower reference temperature line in the graph is a reference temperature line by which a satisfactory temperature region and a unsatisfactory temperature region are divided. Thus, a region A below the lower reference temperature line may be defined as a satisfactory section or a satisfactory region, and a region B above the lower reference temperature line may be defined as a dissatisfied section or a dissatisfied region.

In addition, an upper reference temperature line is a reference temperature line by which an unsatisfactory temperature region and an upper limit temperature region are divided. Thus, a region C above the upper reference temperature line may be defined as an upper limit region or an upper limit section and may be seen as a special operation region.

When defining the satisfactory/unsatisfactory/upper limit temperature regions for controlling the refrigerator, the lower reference temperature line may be defined as either a case of being included in the satisfactory temperature region or a case of being included in the unsatisfactory temperature region. In addition, the upper reference temperature line may be defined as one of a case of being included in the unsatisfactory temperature region and a case of being included in the upper limit temperature region.

When the internal temperature of the refrigerator is within the satisfactory region A, the compressor is not driven, and when the internal temperature of the refrigerator is in the unsatisfactory region B, the compressor is driven so that the internal temperature of the refrigerator is within the satisfactory region.

In addition, when the internal temperature of the refrigerator is in the upper limit region C, it is considered that food having a high temperature is put into the refrigerator, or the door of the storage compartment is opened to rapidly increase in load within the refrigerator. Thus, a special operation algorithm including a load correspondence operation is performed.

(a) of FIG. 7 is a view illustrating a reference temperature line for controlling the refrigerator according to a change in temperature of the refrigerating compartment.

A notch temperature N1 of the refrigerating compartment is set to a temperature above zero. In order to allow the temperature of the refrigerating compartment to be maintained to the notch temperature N1, when the temperature of the refrigerating compartment rises to a first satisfactory critical temperature N11 higher than the notch temperature N1 by a first temperature difference d1, the compressor is controlled to be driven, and after the compressor is driven, the compressor is controlled to be stopped when the temperature is lowered to a second satisfactory critical temperature N12 lower than the notch temperature N1 by the first temperature difference d1.

The first temperature difference d1 is a temperature value that increases or decreases from the notch temperature N1 of the refrigerating compartment, and the temperature of the refrigerating compartment may be defined as a control differential or a control differential temperature, which defines a temperature section in which the temperature of the refrigerating compartment is considered as being maintained to the notch temperature N1, i.e., approximately 1.5° C.

In addition, when it is determined that the refrigerating compartment temperature rises from the notch temperature N1 to a first unsatisfactory critical temperature N13 which is higher by the second temperature difference d2, the special operation algorithm is controlled to be executed. The second temperature difference d2 may be 4.5° C. The first unsatisfactory critical temperature may be defined as an upper limit input temperature.

After the special driving algorithm is executed, if the internal temperature of the refrigerator is lowered to a second unsatisfactory temperature N14 lower than the first unsatisfactory critical temperature by a third temperature difference d3, the operation of the special driving algorithm is ended. The second unsatisfactory temperature N14 may be lower than the first unsatisfactory temperature N13, and the third temperature difference d3 may be 3.0° C. The second unsatisfactory critical temperature N14 may be defined as an upper limit release temperature.

After the special operation algorithm is completed, the cooling capacity of the compressor is adjusted so that the internal temperature of the refrigerator reaches the second satisfactory critical temperature N12, and then the operation of the compressor is stopped.

(b) of FIG. 7 is a view illustrating a reference temperature line for controlling the refrigerator according to a change in temperature of the freezing compartment.

A reference temperature line for controlling the temperature of the freezing compartment have the same temperature as the reference temperature line for controlling the temperature of the refrigerating compartment, but the notch temperature N2 and temperature variations k1, k2, and k3 increasing or decreasing from the notch temperature N2 are only different from the notch temperature N1 and temperature variations d1, d2, and d3.

The freezing compartment notch temperature N2 may be −18° C. as described above, but is not limited thereto. The control differential temperature k1 defining a temperature section in which the freezing compartment temperature is considered to be maintained to the notch temperature N2 that is the set temperature may be 2° C.

Thus, when the freezing compartment temperature increases to the first satisfactory critical temperature N21, which increases by the first temperature difference k1 from the notch temperature N2, the compressor is driven, and when the freezing compartment temperature is the unsatisfactory critical temperature (upper limit input temperature) N23, which increases by the second temperature difference k2 than the notch temperature N2, the special operation algorithm is performed.

In addition, when the freezing compartment temperature is lowered to the second satisfactory critical temperature N22 lower than the notch temperature N2 by the first temperature difference k1 after the compressor is driven, the driving of the compressor is stopped.

After the special operation algorithm is performed, if the freezing compartment temperature is lowered to the second unsatisfactory critical temperature (upper limit release temperature) N24 lower by the third temperature difference k3 than the first unsatisfactory temperature N23, the special operation algorithm is ended. The temperature of the freezing compartment is lowered to the second satisfactory critical temperature N22 through the control of the compressor cooling capacity.

Even in the state that the deep freezing compartment mode is turned off, it is necessary to intermittently control the temperature of the deep freezing compartment with a certain period to prevent the deep freezing compartment temperature from excessively increasing. Thus, the temperature control of the deep freezing compartment in a state in which the deep freezing compartment mode is turned off follows the temperature reference line for controlling the temperature of the freezing compartment disclosed in (b) FIG. 7.

As described above, the reason why the reference temperature line for controlling the temperature of the freezing compartment is applied in the state in which the deep freezing compartment mode is turned off is because the deep freezing compartment is disposed inside the freezing compartment.

That is, even when the deep freezing compartment mode is turned off, and the deep freezing compartment is not used, the internal temperature of the deep freezing compartment has to be maintained at least at the same level as the freezing compartment temperature to prevent the load of the freezing compartment from increasing.

Therefore, in the state that the deep freezing compartment mode is turned off, the deep freezing compartment notch temperature is set equal to the freezing compartment notch temperature N2, and thus the first and second satisfactory critical temperatures and the first and second unsatisfactory critical temperatures are also set equal to the critical temperatures N21, N22, N23, and N24 for controlling the freezing compartment temperature.

(c) of FIG. 7 is a view illustrating a reference temperature line for controlling the refrigerator according to a change in temperature of the deep freezing compartment in a state in which the deep freezing compartment mode is turned on.

In the state in which the deep freezing compartment mode is turned on, that is, in the state in which the deep freezing compartment is on, the deep freezing compartment notch temperature N3 is set to a temperature significantly lower than the freezing compartment notch temperature N2, i.e., is in a range of about −45° C. to about −55° C., preferably −55° C. In this case, it is said that the deep freezing compartment notch temperature N3 corresponds to a heat absorption surface temperature of the thermoelectric module 21, and the freezing compartment notch temperature N2 corresponds to a heat generation surface temperature of the thermoelectric module 21.

Since the refrigerant passing through the freezing compartment expansion valve 15 passes through the heat sink 24, the temperature of the heat generation surface of the thermoelectric module 21 that is in contact with the heat sink 24 is maintained to a temperature corresponding to the temperature of the refrigerant passing through at least the freezing compartment expansion valve. Therefore, a temperature difference between the heat absorption surface and the heat generation surface of the thermoelectric module, that is, $\Delta T$ is 32° C.

The control differential temperature m1, that is, the deep freezing compartment control differential temperature that defines a temperature section considered to be maintained to the notch temperature N3, which is the set temperature, is set higher than the freezing compartment control differential temperature k1, for example, 3° C.

Therefore, it is said that the set temperature maintenance consideration section defined as a section between the first satisfactory critical temperature N31 and the second satisfactory critical temperature N32 of the deep freezing compartment is wider than the set temperature maintenance consideration section of the freezing compartment.

In addition, when the deep freezing compartment temperature rises to the first unsatisfactory critical temperature N33, which is higher than the notch temperature N3 by the second temperature difference m2, the special operation algorithm is performed, and after the special operation algorithm is performed, when the deep freezing compartment temperature is lowered to the second unsatisfactory critical temperature N34 lower than the first unsatisfactory critical temperature N33 by the third temperature difference m3, the special operation algorithm is ended. The second temperature difference m2 may be 5° C.

Here, the second temperature difference m2 of the deep freezing compartment is set higher than the second temperature difference k2 of the freezing compartment. In other words, an interval between the first unsatisfactory critical temperature N33 and the deep freezing compartment notch temperature N3 for controlling the deep freezing compartment temperature is set larger than that between the first unsatisfactory critical temperature N23 and the freezing compartment notch temperature N2 for controlling the freezing compartment temperature.

This is because the internal space of the deep freezing compartment is narrower than that of the freezing compartment, and the thermal insulation performance of the deep freezing case 201 is excellent, and thus, a small amount of the load input into the deep freezing compartment is discharged to the outside. In addition, since the temperature of the deep freezing compartment is significantly lower than the temperature of the freezing compartment, when a heat load such as food is penetrated into the inside of the deep freezing compartment, reaction sensitivity to the heat load is very high.

For this reason, when the second temperature difference m2 of the deep freezing compartment is set to be the same as the second temperature difference k2 of the freezing compartment, frequency of performance of the special operation algorithm such as a load correspondence operation may be excessively high. Therefore, in order to reduce power consumption by lowering the frequency of performance of the special operation algorithm, it is preferable to set the second temperature difference m2 of the deep freezing compartment to be larger than the second temperature difference k2 of the freezing compartment.

A method for controlling the refrigerator according to an embodiment of the present invention will be described below.

Hereinafter, the content that a specific process is performed when at least one of a plurality of conditions is satisfied should be construed to include the meaning that any one, some, or all of a plurality of conditions have to be satisfied to perform a particular process in addition to the meaning of performing the specific process if any one of the plurality of conditions is satisfied at a time point of determination by the controller.

Hereinafter, a method for controlling a voltage applied to the thermoelectric module and the output (or speed) of the deep freezing compartment fan in consideration of a temperature of an indoor space, in which the refrigerator is placed, and internal temperature of the refrigerating compartment, the freezing compartment, and the deep freezing compartment to stably maintain the temperature of the deep freezing compartment will be described.

For this, a controller of the refrigerator may store a lookup table divided into a plurality of room temperature zones (RT zones) according to a range of the room temperature. As an example, as shown in Table 1 below, it may be subdivided into eight room temperature zones (RT zones) according to the range of the room temperature. However, the present invention is not limited thereto.

TABLE 1

| High temperature region | | Medium temperature region | | | Low temperature region | | |
|---|---|---|---|---|---|---|---|
| RT Zone 1 | RT Zone 2 | RT Zone 3 | RT Zone 4 | RT Zone 5 | RT Zone 6 | RT Zone 7 | RT Zone 8 |
| T ≥ 38° C. | 34° C. < T < 38° C. | 27° C. < T < 34° C. | 22° C. < T < 27° C. | 18° C. <T < 22° C. | 12° C. < T < 18° C. | 8° C. < T < 12° C. | T < 8° C. |

In more detail, a zone of the temperature range with the highest room temperature may be defined as an RT zone 1 (or Z1), and a zone of the temperature range with the lowest room temperature may be defined as an RT zone 8 (or Z8). Here, Z1 may be mainly seen as the indoor state in mid-summer, and Z8 may be seen as an indoor state in the middle of winter. Furthermore, the room temperature zones may be grouped into a large category, a medium category, and a small category. For example, as shown in Table 1, the room temperature zone may be defined as a low temperature zone, a medium temperature zone (or a comfortable zone), and a high temperature zone according to the temperature range. For example, if the current room temperature is 38° C. or higher, the room temperature may belong to an RT zone 1 and may be regarded as a high temperature region. Here, a boundary temperature defining the room temperature zone may not be limited to Table 1 and may be variously set.

As another example, in the case of summer in which an external temperature is high, as shown in Table 1, an RT zone 2 or less may be defined as a high temperature zone, whereas in spring, autumn or winter, RT zones 1 to 3 may be defined as high temperature zones, and an RT Zone 4 or higher may be defined as a low temperature zone.

Table 2 below shows a cooling capacity map of the thermoelectric element for controlling the deep freezing compartment, which shows a voltage supplied to the thermoelectric element according to an operation state of the refrigerator.

Since power is not supplied to the thermoelectric element when the deep freezing compartment mode is in the off state, the cooling capacity map below is basically applied when the deep freezing compartment mode is in the on state.

In detail, when the deep freezing compartment mode is in the off state, the deep freezing compartment temperature is not controlled to be maintained at a cryogenic temperature, but is controlled to be maintained at the same temperature as the freezing compartment temperature. Therefore, when the deep freezing compartment mode is in the off state, the deep freezing compartment temperature sensor is periodically turned on to detect the deep freezing compartment temperature, and then an on-off period and time of the deep freezing compartment fan are controlled so that the deep freezing compartment temperature is maintained at a satisfactory temperature of the freezing compartment.

Since the present invention relates to a method for controlling an output of thermoelectric module when the deep freezing compartment mode is in the on state, a description of the control method when the deep freezing compartment mode is in the off state will be omitted.

TABLE 2

| Freezing compartment state | | | Compressor driving state: On, Switch valve state: All open | Referring compartment valve open: Non-defrost | Referring compartment valve open: Defrost | Freezing compartment valve open: Upper limit (C) | Freezing compartment valve open: Unsatisfactory (B) | Freezing compartment valve open: Satisfactory (A) | Off, All lock: Pump down | Off, All lock: Non-defrost | Off, All lock: Defrost |
|---|---|---|---|---|---|---|---|---|---|---|---|
| Deep freezing compartment state | Upper limit/ unsatisfactory | Indoor high-temperature | Medium voltage | Low voltage | Reverse voltage | Low voltage | Medium voltage | First high voltage | Maintain previous output | Low voltage | Reverse voltage |
| | | Indoor low-temperature | | | | | | Second high voltage | | | |
| | Satisfactory | Indoor high-temperature | Low voltage | | | | Low voltage | Low voltage | | | |
| | | Indoor low-temperature | | | | | | | | | |

On the other hand, according to the cooling capacity map of the thermoelectric element shown in Table 2 above, when it is determined that the deep freezing compartment is basically in the on state, and the deep freezing compartment temperature is within the satisfaction region A shown in (c) of FIG. 7, the low voltage may be supplied for all cases except for a case in which a defrost operation of the freezing compartment evaporator is being performed, and thus, this is defined as a low voltage control or low voltage output control. If the deep freezing compartment temperature enters the satisfactory temperature range to cut off supply of power to the thermoelectric module, a temperature difference ΔT between the heat absorption surface and the heat generation surfaces of the thermoelectric element is not generated, but functions as a heat transfer medium. The refrigerant flowing in the heat sink 24 of the thermoelectric module 20 is maintained at a level of the freezing compartment temperature of −28° C., but an internal temperature of the deep freezing compartment 202 is maintained at a cryogenic temperature of −58° C. Then, a heat load of the heat sink 24 is penetrated into the deep freezing compartment 202 along the thermoelectric module 20. As a result, it may cause a phenomenon in which the internal load of the deep freezing compartment naturally increases due to a heat conduction phenomenon. Therefore, when the deep freezing compartment mode is in the on state, it is preferable to apply a low voltage even if the deep freezing compartment temperature is in a satisfactory temperature range to prevent the heat load from being penetrated into the deep freezing compartment through the thermoelectric module.

In addition, when the freezing compartment defrost operation is performed, a reverse voltage is applied to the thermoelectric module 20 so that the deep freezing compartment defrost operation is performed together. Here, the freezing compartment defrosting operation means a defrosting operation of the freezing compartment evaporator, and the deep freezing compartment defrosting operation means a cold sink and heat sink defrost operation of the thermoelectric module.

In detail, since the following problems may occur if the freezing compartment defrost and the deep freezing compartment defrost are not performed together, it is better to be controlled to perform the freezing compartment defrost and the deep freezing compartment defrost together.

First, in a refrigerant circulation system in which the heat sink of the thermoelectric module and the freezing compartment evaporator are connected in series, the compressor has to be driven in order to maintain an operation state of any one of the deep freezing compartment and the freezing compartment. Particularly, for the deep freezing compartment cooling operation, the compressor has to be driven with a maximum cooling capacity.

If, in order to perform only the freezing compartment defrost operation, the compressor operation has to be stopped, or an opening degree of the switching valve 13 has be adjusted to prevent the refrigerant from flowing toward the freezing compartment expansion valve. Here, the meaning of locking the freezing compartment valve may be described as adjusting the opening degree of the switching valve 13 so that the refrigerant does not flow toward the freezing compartment expansion valve 15.

In the same context, the meaning of closing the refrigerating compartment valve may be described as adjusting the opening degree of the switching valve 13 to prevent the refrigerant from flowing toward the refrigerating compartment expansion valve 14.

The simultaneous operation may be described as opening both the freezing compartment valve and the refrigerating compartment valve so that the refrigerant passing through the condenser 12 is divided into the refrigerating compartment expansion valve 14 and the freezing compartment expansion valve 15.

When a freezing compartment valve is closed for defrosting the freezing compartment, the heat sink 24 of the thermoelectric module does not dissipate heat, so the heat absorption ability of the thermoelectric element is lowered, and a backflow of heat from the heat generation surface to the heat absorption surface occurs to cause an increases in load in the deep freezing compartment.

Second, when a reverse voltage is applied to the thermoelectric module for defrosting the deep freezing compartment, the heat generation surface of the thermoelectric module becomes a heat absorption surface to absorb heat from the refrigerant flowing along the heat sink and then transfer the heat to the cold sink 22. Then, frost generated on the cold sink 22 is melted to flow out of the deep freezing compartment, and the defrost water flowing out of the deep freezing compartment flows into the freezing evaporation compartment.

The defrost water flowing into the freezing evaporation compartment may be frozen on a wall of the freezing evaporation compartment maintained at a sub-zero temperature (−28° C.) or may cause a biased frost formation on one surface of the freezing compartment evaporator 17.

In addition, if the reverse voltage is applied for defrosting the deep freezing compartment, the refrigerant flowing along the heat sink 24 is liquefied while losing heat to cause a phenomenon that the liquid refrigerant flows into a suction pipe of an inlet of the compressor.

Particularly, when the freezing compartment temperature is in the satisfactory state, or an operation rate of the freezing compartment fan is low, that is, when the room temperature is in a low temperature region, the refrigerant passing through the freezing compartment evaporator may not be sufficiently vaporized, so that the liquid refrigerant flows into the suction pipe, and as a result, it may cause a problem of lowering the efficiency of the compressor.

Third, when the reverse voltage is applied to the thermoelectric module for defrosting the deep freezing compartment, the cold sink 22 rises to an above zero temperature, but the heat sink 22 is maintained at a refrigerant temperature of −28° C. Thus, a temperature difference (ΔT) of the thermoelectric module becomes large, causing a decrease in the cooling capacity of the thermoelectric module, and when the cooling capacity decreases, the efficiency (COP) also decreases.

For this reason, it is recommended that the freezing compartment defrost and the deep freezing compartment defrost be performed together.

The reverse voltage applied to the thermoelectric module during the defrosting of the freezing compartment may be the maximum reverse voltage, but is not limited thereto. The maximum reverse voltage means a voltage that has the same absolute value as a maximum constant voltage applied to the thermoelectric module and is different only in direction. It is preferable to supply the maximum reverse voltage so that the frost formed on the cold sink 22 is quickly removed within a short time.

In addition, when it is determined that both the current freezing compartment valve and the refrigerating compartment valve are opened, and the temperature of the deep freezing compartment is higher than that of the unsatisfactory region, the medium voltage may be supplied to the thermoelectric module.

In detail, in the simultaneous operation mode, since the refrigerating compartment cooling and the freezing compartment cooling are performed together, when the high voltage is applied to the thermoelectric module 20, the time taken when the freezing compartment temperature enters the satisfactory temperature range increases.

For the cooling operation, it is advantageous to preferentially cool the storage compartment in which the notch temperature N is set to be high in order to prevent the internal temperature of the refrigerator from suddenly increasing and simultaneously to minimize deterioration of food.

Therefore, when the cooling is required in both the freezing compartment and the deep freezing compartment, it is preferable to cool the freezing compartment first and then cool the deep freezing compartment. Here, rather than cooling only the freezing compartment in a state in which the cooling of the deep freezing compartment is paused, it may be advantageous to cool the deep freezing compartment and the freezing compartment together.

Therefore, when a situation requiring the cooling of the deep freezing compartment occurs during the simultaneous operation, it is preferable to supply the medium voltage to the thermoelectric module so that the cooling capacity of the refrigerant passing through the freezing compartment expansion valve 15 is properly distributed between the deep freezing compartment and the freezing compartment.

On the other hand, in the case of the exclusive operation of the refrigerating compartment in which only the refrigerating compartment valve is opened, and the refrigerant flows only toward the refrigerating compartment evaporator, the low-temperature refrigerant does not flow toward the heat sink 24 of the thermoelectric module 20.

In other words, it may be seen that the heat sink 24 of the thermoelectric module 20 does not function as a heat dissipation means when the refrigerating compartment is exclusively operating. In this case, as described above, it is preferable to prevent the thermoelectric module 20 from functioning as a heat conductor for transferring the heat load to the deep freezing compartment.

Therefore, when the exclusive operation mode of the current refrigerating compartment mode and the freezing compartment defrost operation mode are not, it is preferable to supply the minimum voltage. That is, it is preferable to supply the low voltage to the thermoelectric module 20 to minimize heat transferred to the heat sink 24.

Hereinafter, when only the freezing compartment valve is opened, and the refrigerant flows toward the freezing compartment evaporator, control of an output of the thermoelectric element 21 will be described.

First, in the refrigerant circulation system in which the heat sink 24 of the thermoelectric module 20 and the freezing compartment evaporator 17 are connected in series, when the freezing compartment valve is opened to cool the freezing compartment or the deep freezing compartment, the refrigerant flows into the heat sink 24 and the freezing compartment evaporator 17. In this case, the compressor operates at a maximum output.

First, when the temperature of the freezing compartment is in the upper limit temperature region C illustrated in (b) of FIG. 7, it is important to first cool the freezing compartment quickly. Therefore, when the temperature of the freezing compartment is in the upper limit temperature range, the low voltage is applied to the thermoelectric element 21 so that the cooling capacity of the refrigerant flowing into the freezing compartment evaporator 17 is insufficient, and thus the cooling time of the freezing compartment is not prolonged.

If the freezing compartment temperature is in the unsatisfactory temperature region B illustrated in (b) of FIG. 7. In other words, it is possible to maximize efficiency of the refrigerant circulation system by reducing a time difference between the cooling completion times of the two storage compartment, thereby shortening the compressor driving time.

When the freezing compartment temperature is in the satisfactory temperature region A illustrated in (c) of FIG. 7, the high voltage is applied to the thermoelectric element 21 so that the deep freezing compartment temperature rapidly enters the satisfactory temperature region. When the freezing compartment is in the satisfactory temperature range, since the cooling capacity of the refrigerant passing through the freezing compartment expansion valve is used for cooling the deep freezing compartment as much as possible, it is preferable to apply the high voltage to the thermoelectric element 21.

In this case, the voltage applied to the thermoelectric element may be set differently depending on the temperature region of the current room temperature. For example, when it is determined that the room temperature belongs to the high temperature region, a first high voltage may be applied to the thermoelectric element, and when it is determined that the room temperature does not belong to the high temperature region, a second high voltage lower than the first high voltage is applied to the thermoelectric element. The first high voltage and the second high voltage may be an upper limit critical value and a lower limit critical value of the high voltage range, respectively, but are not limited thereto.

In addition, while the freezing compartment cooling operation is performed, the voltage applied to the thermoelectric element 21 may be controlled to be constantly maintained, but as the temperature of the freezing compartment decreases, the voltage applied to the thermoelectric element 21 may be controlled to increase.

For example, as shown in Table 2, when the freezing compartment temperature enters the unsatisfactory temperature region from the upper limit temperature region, the voltage value applied to the thermoelectric element may also be designed to be changed.

As another example, even when the temperature of the freezing compartment decreases, but the temperature region is not changed, the voltage applied to the thermoelectric element may be designed to increase in inverse proportion to the decrease in temperature of the freezing compartment. Specifically, when the temperature of the freezing compartment drops by a set temperature in any one of the upper limit temperature or the unsatisfactory temperature range, the voltage applied to the thermoelectric element may increase by the set value.

On the other hand, when the deep freezing compartment temperature is equal to or higher than the unsatisfactory temperature, and the state is in a pump down operation, the voltage supplied to the thermoelectric element 21 may be applied immediately before the pump down operation.

The pump down operation is an operation mode in which, when all the storage compartments of the refrigerator enter the satisfactory temperature range, before pausing the operation of the refrigerant circulation system, the refrigerant collected in the evaporators is concentrated to the condenser so that the refrigerant shortage does not occur during the next operation.

If entering the pump down operation, a switching chamber valve 13 is first closed to prevent refrigerant from flowing into the evaporator. Then, the compressor may be driven to suction and compress the refrigerant collected in the evaporator so as to be supplied to the condenser.

In general, it is highly likely that the deep freezing compartment temperature is in the satisfactory temperature range before the start of the pump down operation. Thus, the low voltage may be often applied to the thermoelectric element during the pump down operation, but the high voltage may be applied when the pump down operation is performed after a load is applied to the deep freezing compartment to perform a deep freezing compartment correspondence operation.

As another method, while the refrigerant exits the evaporation compartment during the pump down process, the maximum voltage may be applied to the thermoelectric element in order to maximize the cooling capacity of the refrigerant exiting the evaporation compartment for cooling the deep freezing compartment.

In detail, since the temperature of the deep freezing compartment is in a cryogenic state, the chance of problems due to overcooling is very low. Therefore, if the deep freezing compartment is cooled by maximally using the cooling capacity of the refrigerant, the cycle from an end of the pump down and start of the next cycle becomes longer to reduce power consumption.

Hereinafter, a method of setting the voltage range for controlling the output of the thermoelectric element will be described.

As described above, the voltage applied to the thermoelectric element is set differently according to the conditions inside the refrigerator, and the set voltage may be classified into a high voltage, a medium voltage, and a low voltage.

Figure 8:
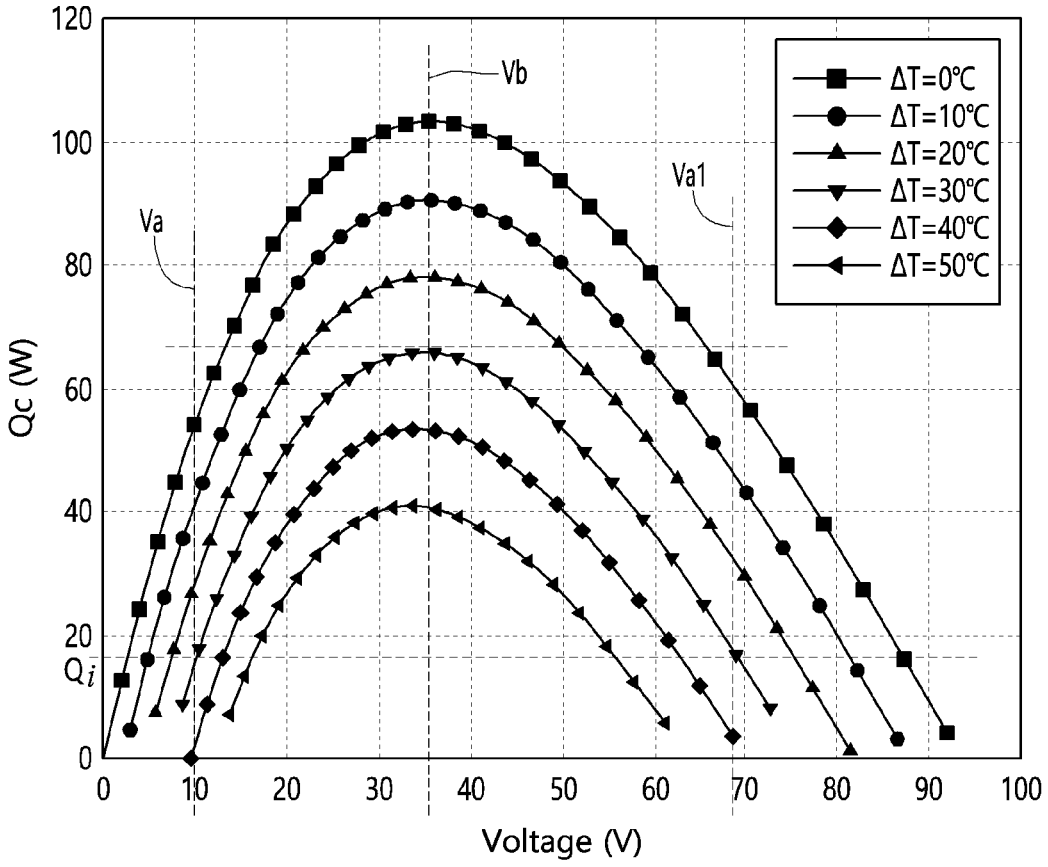
FIG. 8 is a graph illustrating a correlation between a voltage and cooling capacity, which are presented to explain a criterion for determining low voltage and high voltage ranges.

FIG. 8 is a graph illustrating a correlation between a voltage and cooling capacity, which are presented to explain a criterion for determining low voltage and high voltage ranges.

Referring to FIG. 8, as an example of a method of determining a low voltage upper limit value for the output control of the thermoelectric element, the voltage required to generate cooling capacity corresponding to an adiabatic load of a deep freezing case 201 may be determined as a low voltage upper limit value.

Here, the adiabatic load (Watt) of the deep freezing case 201 is a value determined by thermal insulation capability of the deep freezing case and may be defined as an amount of heat load penetrated from the freezing compartment to the deep freezing compartment due to the temperature difference between the freezing compartment and the deep freezing compartment. A unit of the adiabatic load is the same as the cooling capacity.

In detail, an amount of heat loss generated by the temperature difference between the inside and the outside of the deep freezing compartment even when a separate heat load is not applied to the inside of the deep freezing compartment in a state in which the inside and outside of the deep freezing compartment are partitioned by an insulating wall may be defined as an amount of heat load penetrated into the deep freezing compartment. The formula for the adiabatic load ($Q_i$) of the deep freezing compartment is as follows.

$$Q_i = UA(T_h - T_i)$$

U: Over-all coefficient of heat transfer

A: heat transfer area $T_h$: temperature outside deep freezing compartment $T_1$: Internal temperature of deep freezing compartment In addition, since the graph of the cooling capacity ($Q_c$) of the thermoelectric module is defined as an quadratic function of voltage (or quadratic function of current), as illustrated in FIG. 8, when the adiabatic load $Q_i$ is calculated, voltages required to generate the cooling capacity corresponding to the calculated adiabatic load $Q_i$, so-called "minimum adiabatic load voltage $V_a$" and "maximum adiabatic load voltage $V_{a1}$" are determined.

Therefore, when a voltage greater than the minimum adiabatic load voltage and less than the maximum adiabatic load voltage is applied to the thermoelectric module, the cooling capacity of the thermoelectric module may remove the adiabatic load of the deep freezing compartment, thereby lowering the temperature of the deep freezing compartment.

On the other hand, when a voltage lower than the minimum adiabatic load voltage or a voltage higher than the maximum adiabatic load voltage is applied to the thermoelectric module, since the cooling capacity of the thermoelectric module does not completely remove the adiabatic load of the deep freezing compartment, the temperature of the deep freezing compartment may be prevented from suddenly increasing, but it may be difficult to lower the temperature of the deep freezing compartment.

Thus, a low voltage $V_L$ applied to the thermoelectric element may be determined as a voltage value that satisfies following equation: $0<V_L<V_a$.

For example, as shown in the graph of FIG. 8, if assuming that a thermoelectric element having ΔT of 30° C. is used, and the adiabatic load is less than 20 W, the low voltage $V_L$ applied to the thermoelectric element may be determined to a value less than 10 V.

On the other hand, in order to determine the upper limit of the high voltage applied to the thermoelectric element, in the voltage-cooling capacity graph shown in the figure, the voltage value Vb at which a variation in cooling capacity $$\left(\frac{dQ_c}{dV}\right)$$

of the thermoelectric module according to the voltage change becomes 0 (hereinafter "cooling capacity critical voltage") may be determined as an upper limit of the high voltage.

In detail, referring to the cooling capacity graph, as the voltage value applied to the thermoelectric element increases, that is, as a difference in voltage applied to the thermoelectric element increases, the cooling capacity of the thermoelectric element increases.

However, when the voltage applied to the thermoelectric element exceeds the cooling capacity critical voltage, the cooling capacity rather decreases.

Thus, the voltage value Vb at a critical point at which the cooling capacity becomes the maximum and the variation of the cooling capacity becomes 0 may be determined as an upper limit value of the high voltage $V_H$.

For example, if assuming that a thermoelectric element having ΔT of 30° C. is used, the high voltage $V_H$ applied to the thermoelectric element may be determined to be about 35 V.

Figure 9:
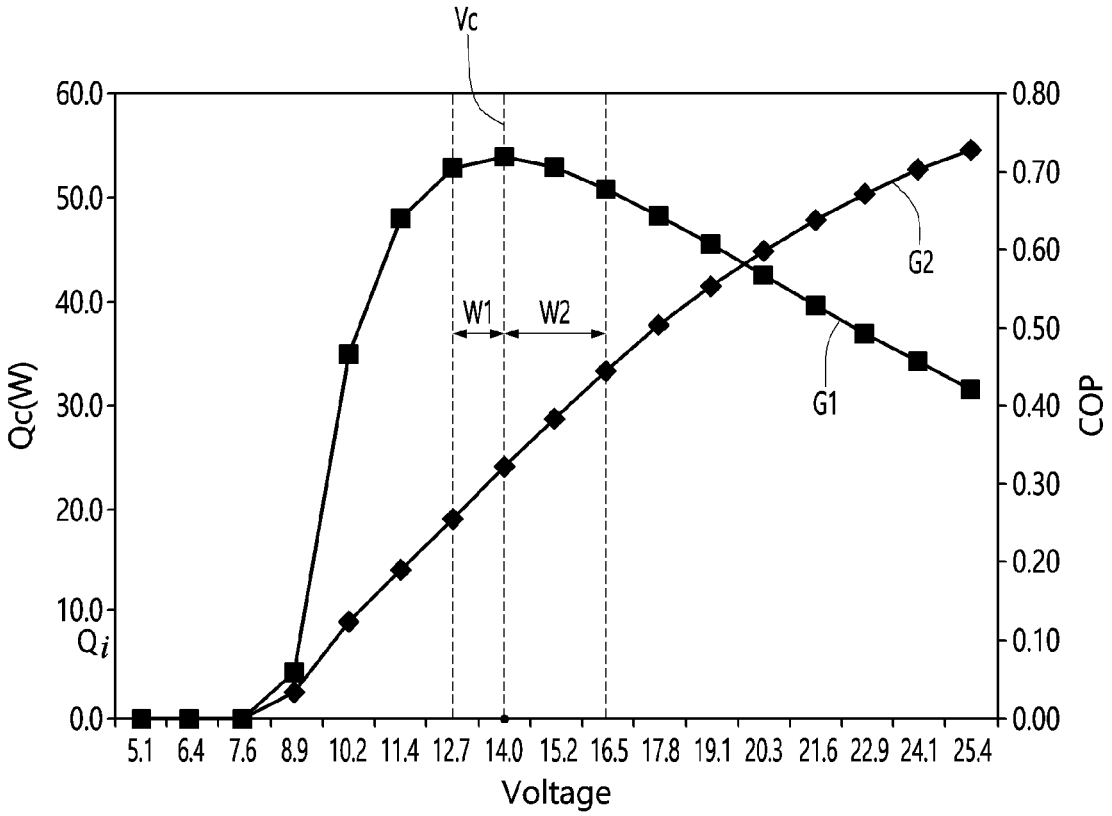
FIG. 9 is a graph illustrating a correlation between cooling capacity and efficiency of a thermoelectric module to a voltage presented to explain a criterion for determining a high voltage range and a medium voltage range.

FIG. 9 is a graph illustrating a correlation between cooling capacity and efficiency of a thermoelectric module to a voltage presented to explain a criterion for determining a high voltage range and a medium voltage range.

The criteria for determining the range of the low voltage $V_L$ and the high voltage $V_H$ have been described in FIG. 8 In some cases, the high voltage $V_H$ may be divided into two or more ranges, such as a first high voltage $V_{H1}$, a second high voltage $V_H$ 2 that is a voltage lower than the first high voltage $V_H$ 1, and a medium voltage $V_M$ to be described later.

Referring to FIG. 9, in order to determine a high voltage range applied to the thermoelectric element, a case in which a thermoelectric element having ΔT of 30° C. is used as an example as described in FIG. 8 will be described.

In the drawing, a graph G1 is an efficiency graph of the thermoelectric element, and a graph G2 is a cooling capacity graph. The cooling capacity graph G2 is a cooling capacity graph in a section in which the voltage is less than 30V in the graph of FIG. 8.

As described in FIG. 8, it is assumed that the voltage value $V_b$ at the point where the variation of the cooling capacity becomes 0 is determined as a high voltage applied to the thermoelectric element.

Then, when the high voltage is applied to the thermoelectric element, it may be advantageous because the cooling capacity of the thermoelectric element is maximized, but since the efficiency (COP) of the thermoelectric element decreases, it is said that it is disadvantageous in terms of the efficiency of the thermoelectric element.

Therefore, in order to determine the upper limit of the high voltage applied to the thermoelectric element, in the voltage-efficiency graph, the voltage value at which a variation in efficiency $$\left(\frac{dCOP}{dV}\right)$$

of the thermoelectric module according to the voltage change becomes 0 (hereinafter "efficiency critical voltage") ($V_c$) more need to be considered.

In detail, it can be seen that not only the efficiency of the thermoelectric element but also the cooling capacity increases until the voltage applied to the thermoelectric module reaches the efficiency critical voltage. However, when the voltage applied to the thermoelectric module exceeds the efficiency critical voltage, it may be seen that the cooling capacity increases but the efficiency decreases.

Thus, the high voltage applied to the thermoelectric element may be determined as an efficiency critical voltage.

Here, when the efficiency critical voltage is exceeded, since the efficiency of the thermoelectric element decreases, but the cooling capacity continues to increase, it may be advantageous to take the cooling capacity value with enduring the efficiency loss in consideration of the overall situation of the deep freezing compartment.

Thus, the high voltage $V_H$ of the thermoelectric element may be determined as a voltage within the following range.

$$(V_c-w1)<V_H\leq(V_c+w2)$$

w1: Efficiency critical voltage reduction width, w2: Efficiency critical voltage increase width The w1 may be 0.8, and the w2 may be 1.2, but is not limited thereto.

If assuming that the efficiency critical voltage $V_c$ is 14 V, a range of the high voltage $V_H$ of the thermoelectric module may be set to 11.2 V or more and 16.8 V or less, and preferably 11 V or more and 17 V or less.

In addition, when the range of the high voltage $V_H$ is determined, a range of the medium voltage $V_M$ may also be determined as follows.

$$V_L<V_M\leq(V_c-w1)$$

Figure 10:
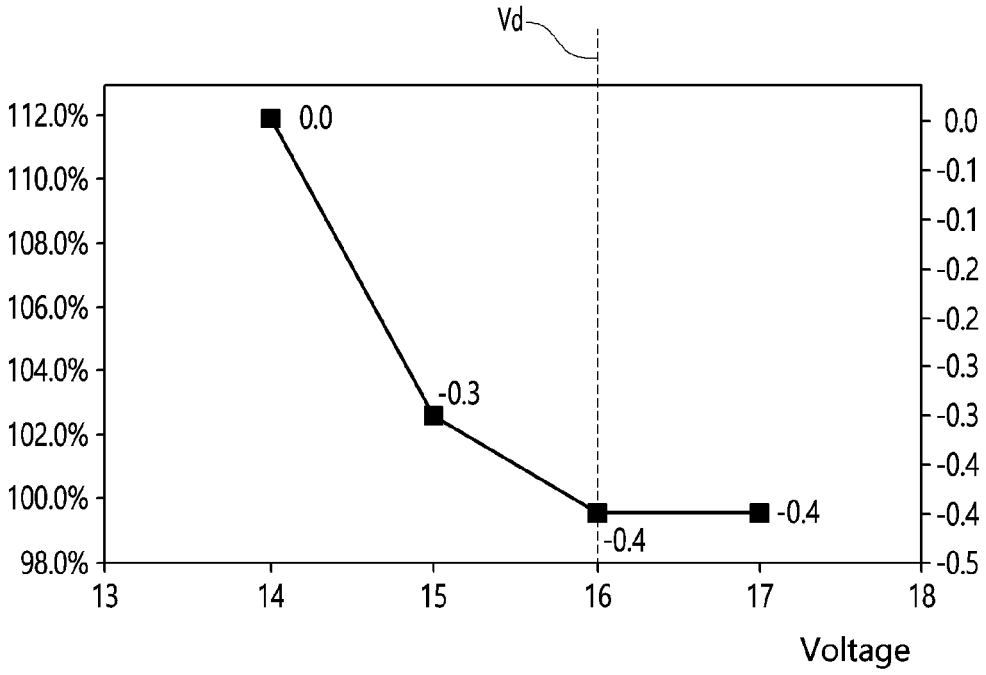
FIG. 10 is a graph illustrating a correlation of a variation in temperature of a deep freezing compartment to a voltage presented to explain a criterion for setting an upper limit of a high voltage of a thermoelectric element.

FIG. 10 is a graph showing the relationship between the voltage and the deep freezing compartment temperature change, which is presented to explain a criterion for setting a high voltage upper limit value of a thermoelectric element.

Referring to FIG. 10, in order to determine the upper limit of the high voltage $V_H$ applied to the thermoelectric element, the following criteria may be applied.

In detail, the upper limit of the high voltage applied to the thermoelectric element may be defined as a temperature critical voltage $V_d$ at a time point when an amount of change in temperature or a variation in temperature $$\left(\frac{d\tau}{dV}\right)$$

in the deep freezing compartment is equal to or less than a set value F1. Here, $\tau$ is an amount of change in temperature, and $d_V$ is an amount of change in voltage.

The set value F1 may be set differently depending on the standard of the thermoelectric element and the adiabatic load of the deep freezing case 201.

As an example, if it is assumed that the voltage at which the temperature change amount is less than 0.1° C. is set as the upper limit of the high voltage, it is seen from the graph of FIG. 10 that the supply voltage at a time point at which the temperature change amount becomes less than 0.1° C. is approximately 16 V.

Summarizing the contents so far, the range of the voltage applied to the thermoelectric element may be defined as shown in Table 3 below.

TABLE 3

| Low voltage | Medium voltage | High Voltage |
|---|---|---|
| 0~11 V | 11 V~13 V | 13 V~17 V |

The low voltage set for controlling an output of the thermoelectric element shown in Table 2 may be 5 V, the medium voltage may be 12 V, the first high voltage may be 16 V, and the second high voltage may be 14 V, but is not limited thereto, and the standard (specification) may vary Since the cooling capacity and efficiency of the thermoelectric element are different according to the supply voltage according to the standard of the thermoelectric element, it will be obvious that the critical voltage for each section has to be also set differently. Table 4 below shows a driving speed of the deep freezing compartment fan corresponding to the output of the thermoelectric element shown in Table 2.

Figure 11:
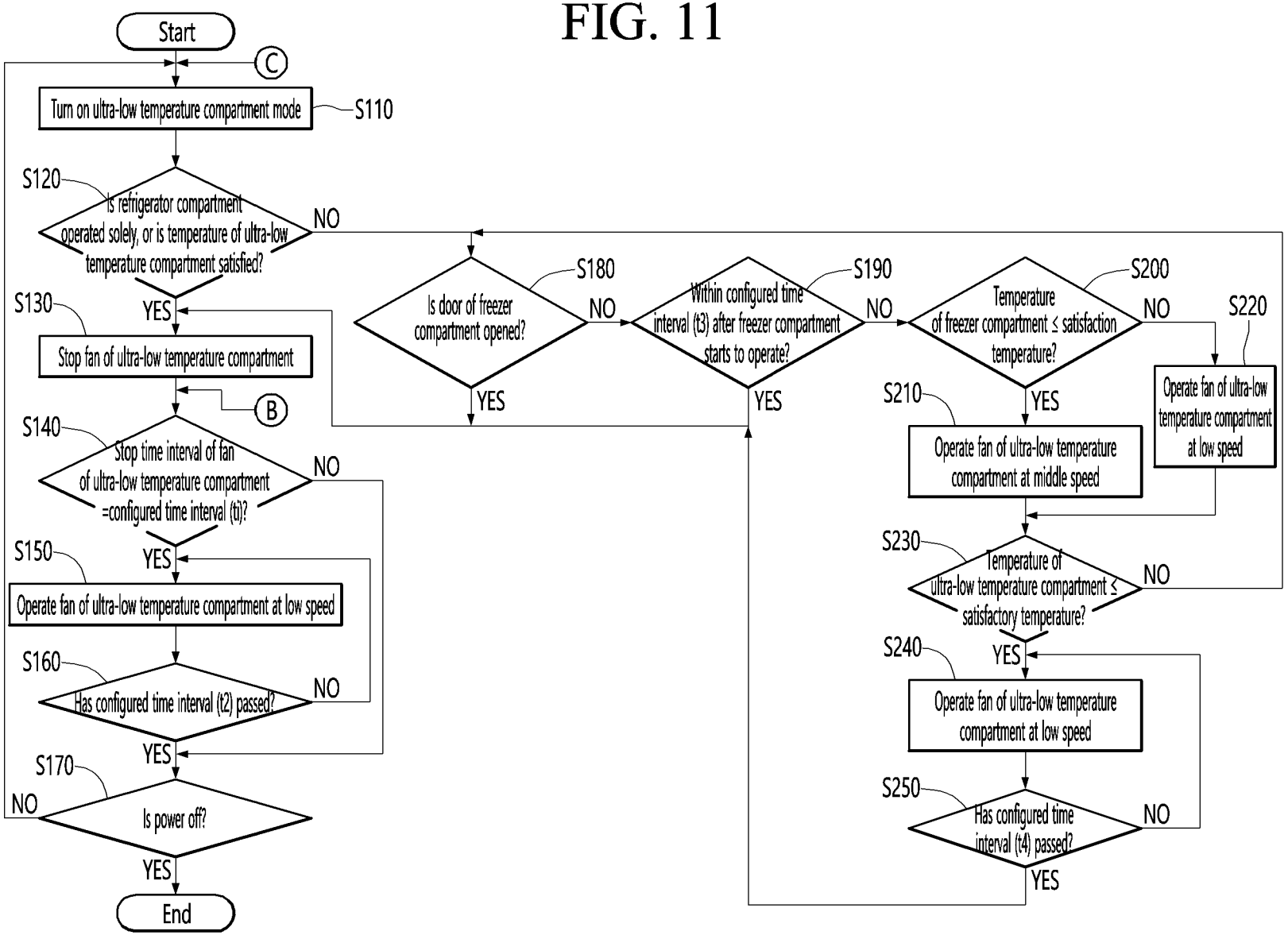
FIG. 11 is a flowchart illustrating a method for controlling driving of a deep freezing compartment fan according to an operation mode of the refrigerator when a deep freezing compartment mode is in an on state.

FIG. 11 is a flowchart illustrating a method for controlling driving of the deep freezing compartment fan according to an operation mode of the refrigerator when a deep freezing compartment mode is in an on state.

Hereinafter, with reference to Table 4 and FIG. 11, a method of controlling a voltage applied to a thermoelectric element and a driving speed of a deep freezing compartment fan according to a refrigerator operating state will be described.

TABLE 4

| Freezing compartment state | | | Compressor driving state | | | | | | | | |
|---|---|---|---|---|---|---|---|---|---|---|---|
| | | | On | | | | | | Off | | |
| | | | Switch valve state | | | | | | | | |
| | | | | Referring compartment valve open | | Freezing compartment valve open | | | All lock | | |
| | | | All open | Non-defrost | Defrost | Upper limit (C) | Unsatisfactory (B) | Satisfactory (A) | Pump Down | Non-defrost | Defrost |
| Deep freezing compartment state | Upper limit/ unsatisfactory | Indoor high temperature | Lower speed | Pause | Pause | Lower speed | Lower speed | Medium speed | Pause or low speed | Pause | Pause |
| | | Indoor low temperature | | | | | | | | | |
| | Satisfactory | Indoor high temperature | Pause | | | | Pause | Pause | | | |
| | | Indoor low temperature | | | | | | | | | |

When the deep freezing compartment mode is turned on, a user presses a deep freezing compartment mode execution button to indicate that the deep freezing compartment mode is in a state capable of being performed. Thus, in the state in which the deep freezing compartment mode is turned on, power may be immediately applied to the thermoelectric module when the specific condition is satisfied.

Conversely, a state in which the deep freezing compartment mode is turned off means a state in which power supply to the thermoelectric module is cut off. Thus, power is not supplied to the thermoelectric module and the deep freezing compartment fan except for exceptional cases.

The control method described with reference to FIGS. 8 to 10 may be applied to a method of controlling a voltage applied to the thermoelectric module of the storage compartment A in addition to the deep freezing compartment.

Referring to FIG. 11, if the deep freezing compartment mode is in an on state (S110), the controller determines whether the current operation mode is in a non-operation state of the deep freezing compartment (S120).

Determining whether the deep freezing compartment is in the non-operational state may be described as determining whether the current refrigerator operation condition is an exclusive operation state of the refrigerating compartment, or a current deep freezing compartment temperature is in a satisfactory state.

Here, the condition that the deep freezing compartment is in the satisfactory state means that the temperature of the deep freezing compartment is in the satisfactory temperature region A of the deep freezing compartment illustrated in (c) of in FIG. 7.

The exclusive operation of the refrigerating compartment means a situation in which the switching valve 13 is switched toward the refrigerating compartment expansion valve 14 for cooling the refrigerating compartment, and thus, the refrigerant flows only toward the refrigerating compartment expansion valve 14.

If the refrigeration compartment is exclusively operating, or the deep freezing compartment temperature is in the satisfactory state, the deep freezing compartment fan is paused or maintained in a paused state (S130).

When the refrigerating compartment is exclusively operating, since the refrigerant does not flow toward the freezing compartment expansion valve 15, it means that the refrigerant does not flow even through the heat sink 24 Therefore, in this state, since the thermoelectric module is in a state in which a function as the cooling member is not performed, the deep freezing compartment fan 25 is controlled not to be driven.

In this state, as shown in Table 2, if the refrigerating compartment is exclusively operating, and the freezing compartment is not defrosted, the low voltage is applied to the thermoelectric element.

If the current deep freezing compartment temperature is the satisfactory temperature state, since there is no need to drive the deep freezing compartment fan, it will be natural that the deep freezing compartment fan 25 is controlled not to be driven. Therefore, as shown in Table 3, when the deep freezing compartment temperature is a satisfactory temperature state, the deep freezing compartment fan is controlled to be paused or maintained in the paused state.

The controller determines whether a pause time of the deep freezing compartment fan continues for more than a set time $t_1$ (S140). Here, the set time $t_1$ may be 60 minutes, but is not limited thereto.

If the deep freezing compartment fan is maintained in the stationary state for a long time in the cryogenic state inside the deep freezing compartment, the deep freezing compartment fan and a rotating shaft are frozen, and thus a phenomenon in which the rotation shaft does not rotate even when power is applied may occur. Therefore, when the pause state of the deep freezing compartment fan is maintained for more than the set time $t_1$, the controller drives the deep freezing compartment fan at a low speed (S150).

When the set time $t_2$ elapses, the controller pauses the deep freezing compartment fan (S160), determines whether the refrigerator is powered off (S170) to end the operation of the deep freezing compartment fan driving algorithm or to continuously repeat the operation.

Here, the set time $t_2$ in which the deep freezing compartment fan is driven at the low speed may be 10 seconds, but is not limited thereto.

On the other hand, in the process of determining whether the refrigerating compartment is exclusively operating (S120), if it is determined that the refrigerating compartment is not exclusively operating, and the temperature of the deep freezing compartment is not in the satisfactory state, a process of determining whether the freezing compartment door is in an open state is performed (S180).

Here, it is said that the refrigerating compartment does not exclusively operate means any one of the exclusive operation of the freezing compartment or the simultaneous operation for cooling the refrigerating compartment and the freezing compartment at the same time.

If it is determined that the freezing compartment door is in the open state, the deep freezing compartment fan is paused, or the process proceeds to the process (S130) of maintaining the paused state.

In a state in which the freezing compartment door is opened, there may be a situation in which food is put in or food is taken out by opening the inside of the freezing compartment or the deep freezing compartment drawer. Therefore, when it is determined that the freezing compartment door is in the open state, the deep freezing compartment fan is controlled not to be driven.

In addition, if it is determined that the freezing compartment door is closed, the controller determines whether a set time $t_3$ elapses after the freezing compartment operation starts (S190).

When it is determined that the current time point is a state in which the set time does not elapse after the start of the operation of the freezing compartment, the process proceeds to the process S130 of pausing the deep freezing compartment fan or maintaining the paused state of the deep freezing compartment fan.

That is, when it is determined that the current deep freezing compartment mode is in the on state, the controller controls the refrigerator to proceed to operation S130 when the current operation condition satisfies at least one of the conditions of operations S120, S180, and S190 described above. It is natural that this should be interpreted as including a case in which all the conditions of operations S120, S180, and S190 are satisfied.

In addition, the operations S180 and S190 are sequentially performed, but there is no limitation in order of execution.

Since it is important to lower the freezing compartment temperature to a set level at the initial process of the operation of the freezing compartment, the refrigerant passing through the freezing compartment expansion valve 15 is controlled to be heat-exchanged intensively with the cold air in the freezing compartment for a predetermined time.

The set time $t_3$ may be 90 seconds, but is not limited thereto.

In addition, if it is determined that the set time $t_3$ elapses after the start of the freezing compartment operation, the controller determines whether the current freezing compartment temperature is the satisfactory temperature (S200).

That is, when it is determined that the current deep freezing compartment mode is in the on state, the controller may be summarized to proceed to operation S200 if the current operation conditions do not satisfy all of the conditions of operations S120, S180, and S190 described above.

If it is determined that the freezing compartment temperature is not in the satisfactory temperature state, the deep freezing compartment fan is driven at the low speed (S220), and thus, the freezing compartment temperature is quickly cooled to the satisfactory region A illustrated in (c) of FIG. 7.

That is, when the freezing compartment temperature in Table 2 belongs to any one of the upper limit temperature region and the unsatisfactory temperature region, the deep freezing compartment fan is driven at the low speed. However, the present invention is not limited thereto, and when the freezing compartment temperature is in the unsatisfactory temperature range, it is also possible to control the deep freezing compartment fan to operate at the medium speed.

On the other hand, if it is determined that the freezing compartment temperature is in the current satisfactory range, the deep freezing compartment fan is driven at the medium speed (S210), and thus, the deep freezing compartment is cooled to a set temperature.

When the freezing compartment temperature is in the satisfactory temperature state, the freezing compartment fan is not driven, and thus, heat exchange may not substantially occur in the freezing compartment evaporator 17. Therefore, it is preferable to increase in rotation speed of the deep freezing compartment fan so that the refrigerant passing through the heat sink 24 is heat-exchanged with the cool deep freezing compartment to rapidly cool the deep freezing compartment temperature to a set temperature.

On the other hand, it is continuously determined whether the deep freezing compartment temperature enters the satisfactory region while the deep freezing compartment fan is being driven at the low speed or the medium speed. That is, the deep freezing compartment temperature sensor (not shown) mounted on a front surface of the deep freezing temperature module and exposed to the cold air of the deep freezing compartment continuously detects the deep freezing compartment temperature and transmits the detected result to the controller.

The controller determines whether the deep freezing compartment temperature enters the satisfactory region A based on the transmitted deep freezing compartment temperature sensing value (S230).

If it is determined that the deep freezing compartment temperature is not in the satisfactory state, the process returns to the process (S180) of determining whether the freezing compartment door is opened, and the subsequent process is repeated.

However, the present invention is not limited to returning to operation S180, and it is also possible to control the return to any one of operations S120, S190, and S200.

Here, a situation in which the user opens the freezing compartment door while the deep freezing compartment fan is being driven at the low speed or the medium speed may occur, and in this case, it is necessary to immediately pause the deep freezing compartment fan. Thus, when the deep freezing compartment fan is operating, and the deep freezing compartment temperature is not in the satisfactory region, it is necessary for the controller to continuously or periodically detect whether the freezing compartment door is opened.

If it is determined that the deep freezing compartment temperature drops to the satisfactory region, the deep freezing compartment fan is controlled to be driven at the low speed (S240).

If the deep freezing compartment temperature is being driven at the low speed even when the temperature is in the unsatisfactory state, the low speed operation is maintained, and if it is being driven at the medium speed or higher, the speed is changed to the low speed.

If it is determined that a low speed driving time of the deep freezing compartment fan elapses over the set time $t_4$ in the state in which the deep freezing compartment temperature is in the satisfactory region (S250), the process proceeds to the process (S130) of pausing the deep freezing compartment fan. The process of determining whether the pause time of the deep freezing compartment fan exceeds the set time $t_1$ is repeatedly performed. The set time $t_4$ may be 90 seconds, but is not limited thereto.

Here, the reason for further driving the deep freezing compartment fan for the set time $t_4$ even after the deep freezing compartment temperature is within the satisfactory region is as follows. In detail, even if the power supplied to the thermoelectric element 21 is cut off due to the end of the deep freezing compartment cooling operation, the cold sink 22 of the module 20 is maintained in a state below the deep freezing compartment temperature for a certain time period. This is for maximally supplying the cold air, which remains in the cold sink, to the deep freezing compartment.

In other words, even after the power supply to the thermoelectric element is cut off, while the temperature of the cold sink 22 is maintained below the temperature of the deep freezing compartment, the cold sink 22 and the cold sink 22 may be heat-exchanged heat with each other. This is for more absorbing heat from the deep freezing compartment into the cold sink 22.

As described above, if the remaining cooling air remaining in the cold sink 22 is used maximally, cooling capacity and efficiency of the thermoelectric module may be improved.

However, when the deep freezing compartment temperature enters the satisfactory temperature range, it is also possible to directly proceed to operation S130 of pausing the deep freezing compartment fan without performing operations S240 and S250 of additionally driving the deep freezing compartment fan.

As another example, if it is determined that the current deep freezing compartment mode is in the on state, the controller does not separately determine whether the freezing compartment temperature is satisfied when the current operation conditions do not satisfy all of the conditions of operations S120, S180, and S190 described above, and as a result, it may be also possible to control the deep freezing compartment fan to be driven at a specific speed. It should be noted here that the specific speed may include other speeds in addition to the low and medium speeds.

As another embodiment, even if at least one of operations S120, S180, and S190 is not satisfied, it is possible to directly proceed to operation S200, or to directly proceed to the process of rotating the deep freezing compartment fan at the specific speed.

The invention claimed is:

1. A refrigerator, comprising:

a refrigerating compartment;

a freezing compartment partitioned from the refrigerating compartment;

a deep freezing compartment accommodated in the freezing compartment and partitioned from the freezing compartment;

a thermoelectric module to cool the deep freezing compartment to a temperature lower than that of the freezing compartment;

a temperature sensor to detect a temperature of the deep freezing compartment;

a deep freezing compartment fan to cause an internal air of the deep freezing compartment to forcibly flow; and a controller configured to control driving of the thermoelectric module and the deep freezing compartment fan, wherein the controller is configured to apply any one of a low voltage, a medium voltage, a high voltage, and a reverse voltage to the thermoelectric module according to an operation mode of the refrigerator, and is configured to operate the deep freezing compartment fan at any one of low speed, medium speed, and high speed, wherein, a deep freezing compartment mode being in an on state, in response to the temperature of the deep freezing compartment being in a satisfactory temperature region, the controller is configured to apply the low voltage to the thermoelectric module, and in response to the deep freezing compartment temperature being out of the satisfactory temperature region, the controller is configured to apply the medium voltage to the thermoelectric module.

2. The refrigerator according to claim 1, wherein, in response to the deep freezing compartment temperature entering a satisfactory temperature region, the controller is configured to control the deep freezing compartment fan to stop after being driven for a set time at the low speed.

3. The refrigerator according to claim 1, wherein, in response to a freezing compartment defrost operation being started, the controller is configured to apply the reverse voltage to the thermoelectric module and perform the freezing compartment defrost operation and a deep freezing compartment defrost operation at the same time.

4. The refrigerator according to claim 1, wherein, in response to the refrigerator operating in a simultaneous operation mode in which both a freezing compartment valve and a refrigerating compartment valve are opened, the controller is configured to apply a voltage to the thermoelectric module that is differently set according to a temperature of the deep freezing compartment.

5. A refrigerator, comprising:

a refrigerating compartment;

a freezing compartment partitioned from the refrigerating compartment;

a deep freezing compartment accommodated in the freezing compartment and partitioned from the freezing compartment;

a thermoelectric module to cool the deep freezing compartment to a temperature lower than that of the freezing compartment;

a temperature sensor to detect a temperature of the deep freezing compartment;

a deep freezing compartment fan to cause an internal air of the deep freezing compartment to forcibly flow; and a controller configured to control driving of the thermoelectric module and the deep freezing compartment fan, wherein the controller is configured to apply any one of a low voltage, a medium voltage, a high voltage, and a reverse voltage to the thermoelectric module according to an operation mode of the refrigerator, and is configured to operate the deep freezing compartment fan at any one of low speed, medium speed, and high speed, wherein, a deep freezing compartment mode being in an on state, in response to a freezing compartment defrost operation being started, the controller is configured to apply the reverse voltage to the thermoelectric module and perform the freezing compartment defrost operation and a deep freezing compartment defrost operation at the same time.

6. A refrigerator, comprising:

a refrigerating compartment;

a freezing compartment partitioned from the refrigerating compartment; a deep freezing compartment accommodated in the freezing compartment and partitioned from the freezing compartment;

a thermoelectric module to cool the deep freezing compartment to a temperature lower than that of the freezing compartment;

a temperature sensor to detect a temperature of the deep freezing compartment;

a deep freezing compartment fan to cause an internal air of the deep freezing compartment to forcibly flow; and a controller configured to control driving of the thermoelectric module and the deep freezing compartment fan, the controller is configured to apply any one of a low voltage, a medium voltage, a high voltage, and a reverse voltage to the thermoelectric module according to an operation mode of the refrigerator, and is configured to operate the deep freezing compartment fan at any one of low speed, medium speed, and high speed, wherein, a deep freezing compartment mode being in an on state, in response to the refrigerator operating in an exclusive operation mode of the refrigerating compartment, the controller is configured to apply the low voltage to the thermoelectric module.

7. The refrigerator according to claim 6, wherein, in response to the refrigerator being in the exclusive operation mode of the refrigerating compartment, the controller is configured to stop or maintain a stopped state of an operation of the deep freezing compartment.

8. The refrigerator according to claim 6, wherein, in response to the refrigerator operating in the exclusive operation mode of the refrigerating compartment, and the deep freezing compartment temperature is above an unsatisfactory temperature region, the controller is configured to apply a voltage to the thermoelectric module that is differently set according to at least one of the freezing compartment temperature or the room temperature.

9. The refrigerator according to claim 8, wherein, in response to the refrigerator being in the exclusive operation mode of the freezing compartment, and the freezing compartment temperature being in an upper limit temperature region, the controller is configured to apply the low voltage to the thermoelectric module.

10. The refrigerator according to claim 9, wherein, in response to the freezing compartment temperature being in an unsatisfactory temperature region, the controller is configured to apply the medium voltage to the thermoelectric module.

11. The refrigerator according to claim 10, wherein, in response to the freezing compartment temperature being in the upper limit temperature or unsatisfactory temperature region, the controller is configured to control the deep freezing compartment fan to be driven at the low speed.

12. The refrigerator according to claim 9, wherein, in response to the freezing compartment temperature being in a satisfactory temperature region, the controller is configured to apply the high voltage to the thermoelectric module.

13. The refrigerator according to claim 12, wherein, in response to the freezing compartment temperature being in the satisfactory temperature region, the controller is configured to control the deep freezing compartment fan to be driven at the medium speed.

* * * * *